US009272829B2

(12) United States Patent
Wynnick et al.

(10) Patent No.: US 9,272,829 B2
(45) Date of Patent: Mar. 1, 2016

(54) STACKING BRACKET

(71) Applicant: Lennox Industries Inc., Richardson, TX (US)

(72) Inventors: David Michael Wynnick, Lewisville, TX (US); Timothy Grant Weigel, McKinney, TX (US); Christopher Whitesides, Providence Village, TX (US)

(73) Assignee: Lennox Industries Inc., Richardson, TX (US)

( * ) Notice: Subject to any disclaimer, the term of this patent is extended or adjusted under 35 U.S.C. 154(b) by 0 days.

(21) Appl. No.: 14/624,259

(22) Filed: Feb. 17, 2015

(65) Prior Publication Data

US 2015/0158647 A1 Jun. 11, 2015

Related U.S. Application Data

(63) Continuation-in-part of application No. 14/022,174, filed on Sep. 9, 2013, now Pat. No. 9,151,535.

(51) Int. Cl.

| | |
|---|---|
| ***F16M 1/00*** | (2006.01) |
| ***F16M 3/00*** | (2006.01) |
| ***F16M 5/00*** | (2006.01) |
| ***F16M 7/00*** | (2006.01) |
| ***F16M 9/00*** | (2006.01) |
| ***F16M 11/00*** | (2006.01) |
| ***B65D 69/00*** | (2006.01) |
| ***F24F 13/32*** | (2006.01) |
| ***B65D 6/00*** | (2006.01) |
| ***B65D 67/02*** | (2006.01) |

(52) U.S. Cl.

CPC *B65D 69/00* (2013.01); *B65D 7/00* (2013.01); *B65D 67/02* (2013.01); *F24F 13/32* (2013.01)

(58) Field of Classification Search

CPC ..... F16M 13/02; F16M 5/00; F16M 2200/08; F16M 13/00; F16M 11/00; F16M 7/00; F16M 11/10; F16M 13/025; F25D 23/10; F24M 13/32; B65D 69/00; B65D 81/025; B65D 81/056; B65D 81/058; B65D 21/02; B65D 21/0215; A47B 13/021; A47B 91/00; A47B 21/0314

See application file for complete search history.

(56) References Cited

U.S. PATENT DOCUMENTS

| | | | | | |
|---|---|---|---|---|---|
| 1,541,872 | A * | 6/1925 | Stoddard | B65D 9/34 | 217/69 |
| 2,008,914 | A * | 7/1935 | Keiner | B65D 9/38 | 217/15 |
| 2,030,109 | A * | 2/1936 | Hopwood | B65D 21/0215 | 217/19 |
| 3,724,654 | A * | 4/1973 | Gerard et al. | 206/459.5 | |
| 5,889,231 | A * | 3/1999 | Marusinec et al. | 174/50 | |

(Continued)

*Primary Examiner* — Brian Mattei
(74) *Attorney, Agent, or Firm* — R. Johnston Law, PLLC

(57) ABSTRACT

The present invention provides an apparatus for supporting stacking of a top heating, ventilation, and air conditioning (HVAC) unit on top of a bottom HVAC unit. The apparatus includes a base member configured to mount to a top cover of the bottom HVAC unit. The base member comprises an upper base portion with a top surface configured to receive at least a portion of a base rail of the top HVAC unit. The apparatus further comprises a stacking insert extending away from the base member. The stacking insert has one or more sloped surfaces extending above the top surface of the upper base portion. The top surface extends from a base of the one or more sloped surfaces in a plane substantially parallel to the top cover, when the base member is mounted to the top cover of the bottom HVAC unit.

25 Claims, 12 Drawing Sheets

(56) References Cited

U.S. PATENT DOCUMENTS 6,488,247 B1 * 12/2002 Gonzalez ..... 248/201
6,530,191 B2 * 3/2003 Rieke et al. ..... 52/794.1
6,631,878 B1 * 10/2003 Adam ..... 248/188.4
6,805,241 B2 * 10/2004 Smith ..... 206/592
8,074,952 B2 * 12/2011 Baechle ..... 248/346.03
2007/0108359 A1 * 5/2007 Lee et al. ..... 248/372.1

* cited by examiner

STACKING BRACKET

CROSS-REFERENCE TO RELATED APPLICATIONS

This application is a continuation in part and claims the benefit of the filing date of co-pending U.S. patent application Ser. No. 14/022,174, filed Sep. 9, 2013, and claims priority therefrom. The contents of the prior application are hereby incorporated by reference with the same effect as if fully set forth herein.

FIELD OF THE INVENTION

The present invention relates to stacking of heating, ventilation, and air conditioning units and, more particularly, to devices to support stacking heating, ventilation, and air conditioning units.

DESCRIPTION OF RELATED ART

Heating, ventilation, and air conditioning (HVAC) units are typically transported in an enclosed van or on a flatbed. Wood crating members mounted around the HVAC unit provide protection to the surfaces and internal components of the HVAC unit when the HVAC units are bumped, jostled, or otherwise disturbed during transport.

The HVAC units may be stacked with a top HVAC unit on a bottom HVAC unit because of space constraints and to save on transportation costs. The wood crating members may provide protection to the top surface of the bottom HVAC unit by maintaining spacing between the bottom of the top HVAC unit, referred to as a base rail, and the top surface of the bottom HVAC unit. Wood crating may also be used in the storage of stacked HVAC units, for example storage at a warehouse.

An HVAC unit may also be strapped to a flatbed truck, either as a single HVAC unit, with one or more straps extend across the top of the single HVAC unit, or in a stacked configuration, with the straps extending across the top of the top HVAC unit.

The use of wood crating increases the materials and labor costs related to storage or transport of HVAC units. The wood crating further increases costs to contractors that install the HAVC units and generates waste that must be disposed of by the contractors or the HVAC unit owners.

The HVAC unit, or stacked HVAC units, may experience disturbance forces during transportation. The HVAC unit, or units, may slide along the bed of the truck in response to these disturbance forces. For stacked pairs of HVAC units, the top unit may slide along, and possibly off of, the top cover of the bottom unit upon which it is stacked. The wood crating offers little resistance to sliding of the HVAC units in response to disturbance forces. The sliding resistance provided by the straps, alone, may not be enough to resist such sliding of the HVAC units during transportation. Additionally, the straps may migrate along the top of the HVAC unit, and possibly slide off the top cover of the HVAC unit, as the HVAC unit position slides in response to disturbance forces.

SUMMARY

The present invention provides an apparatus for supporting stacking of a top heating, ventilation, and air conditioning (HVAC) unit on top of a bottom HVAC unit.

A first apparatus is provided for supporting stacking of HVAC units, and comprises a base member configured to couple to a top cover of the bottom HVAC unit and configured to receive at least a portion of the base rail of the top HVAC unit. A raised insert portion extends above the base member and comprises one or more ramp surfaces and one or more impact surfaces, wherein each of the one or more ramp surfaces is configured to be positioned adjacent to an inner wall of a base rail of the top HVAC unit. Each of the one or more ramp surfaces extends in a direction substantially parallel to the respective adjacent inner wall of the base rail of the HVAC unit. And, each of the one or more impact surfaces is configured to face an inner wall of a base rail of the top HVAC unit.

A first system is provided for supporting stacking of HVAC units, and comprises a first, second, third, and fourth stacking bracket, each configured to mount on a top cover of a bottom HVAC and support a portion of a base rail of a top HVAC unit. Each bracket comprises a base member configured to couple to a top cover of the bottom HVAC unit and configured to receive at least a portion of the base rail of the top HVAC unit. A raised insert portion extends above the base member and comprises one or more ramp surfaces and one or more impact surfaces, wherein each of the one or more ramp surfaces is configured to be positioned adjacent to an inner wall of a base rail of the top HVAC unit. Each of the one or more ramp surfaces extends in a direction substantially parallel to the respective adjacent inner wall of the base rail of the HVAC unit. Each of the one or more impact surfaces is configured to face an inner wall of a base rail of the top HVAC unit. The stacking brackets are configured to operate in combination to resist disengagement of a top HVAC unit from the bottom HVAC unit.

The apparatus and system provided, herein, may, advantageously provide surfaces against which a top HVAC unit may slide, or impact, in response to disturbance forces while resisting dislodgement of the top HVAC unit. The apparatus and system may provide lateral resistance to movement of the top HVAC unit relative the bottom HVAC unit while providing substantially no resistance to substantially vertical movement of the top HVAC unit. Accordingly, the top HVAC unit may be lifted from the bottom HVAC unit without interference from the stacking brackets. Further, the stacking brackets may provide additional features that may aid in locating tie down straps for securing the HVAC unit, or units to a flat surface.

BRIEF DESCRIPTION OF THE DRAWINGS

For a more complete understanding of the present invention and the advantages thereof, reference is now made to the following Detailed Description taken in conjunction with the accompanying drawings, in which.

DETAILED DESCRIPTION

Stacking Bracket Having Sloped Surfaces 106, 108

Figure 1:
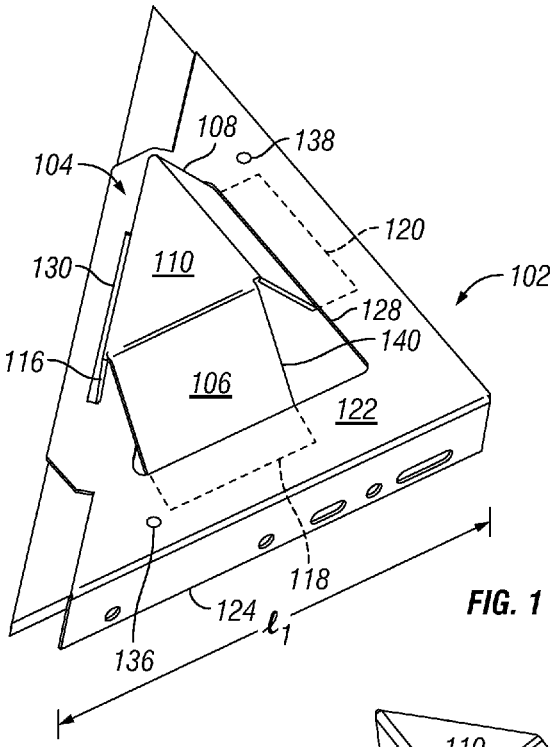
FIG. 1 is a perspective view of a first embodiment of the stacking bracket.
Figure 2:
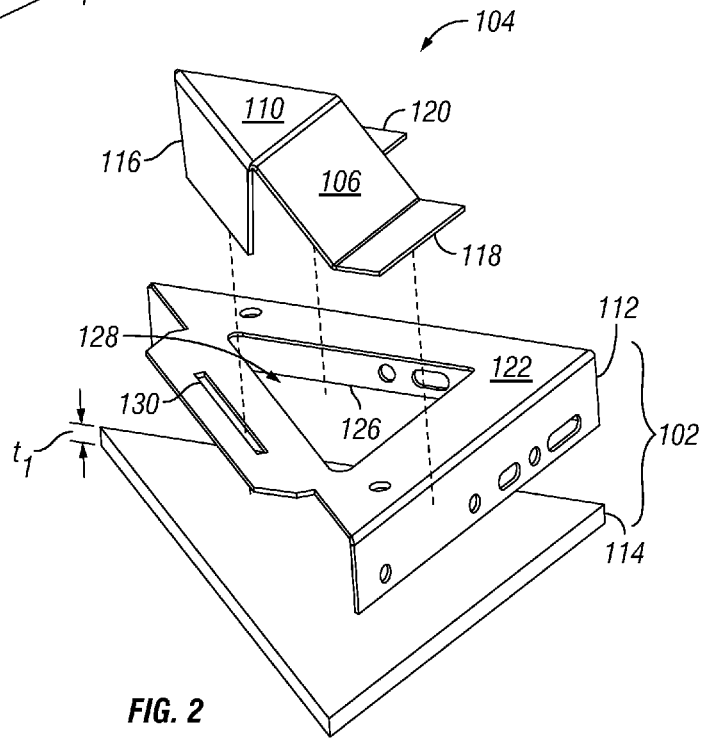
FIG. 2 is an exploded view of a first embodiment of the stacking bracket.

Referring to FIGS. 1 and 2, in a first embodiment, a first stacking bracket 100 for stacking a top HVAC unit (referred to as a "unit") on a bottom unit may comprise a base member 102 and a stacking insert 104. The first stacking bracket 100 is configured to be mounted to a top cover 12 (shown in FIG. 3A) of a bottom unit 10. In some embodiments, the first stacking bracket 100 is attached to a corner 16 of the bottom unit 10, as shown in FIGS. 3B and 4.

As shown in FIG. 1, the first stacking insert 104 may be coupled to the base member 102. The stacking insert 104 may comprise one or more substantially sloped surfaces 106, 108 extending from a top surface 110 of the stacking insert 104 to a top surface 122 of the base member 102, when the base member 102 and stacking insert 104 are coupled and mounted to the bottom unit 10. The sloped surfaces 106,108 may be configured to impede displacement of a top unit 20 that has been stacked on top of the bottom unit 10.

Figure 4:
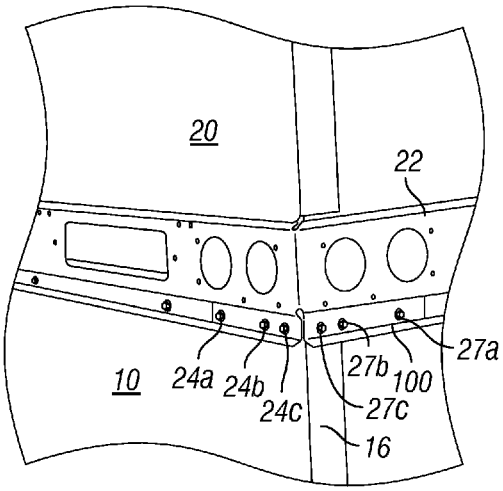
FIG. 4 is a view of a top HVAC unit stacked on top of a HVAC bottom unit having a first embodiment of the stacking mounted on the bottom HVAC unit.
Figure 5:
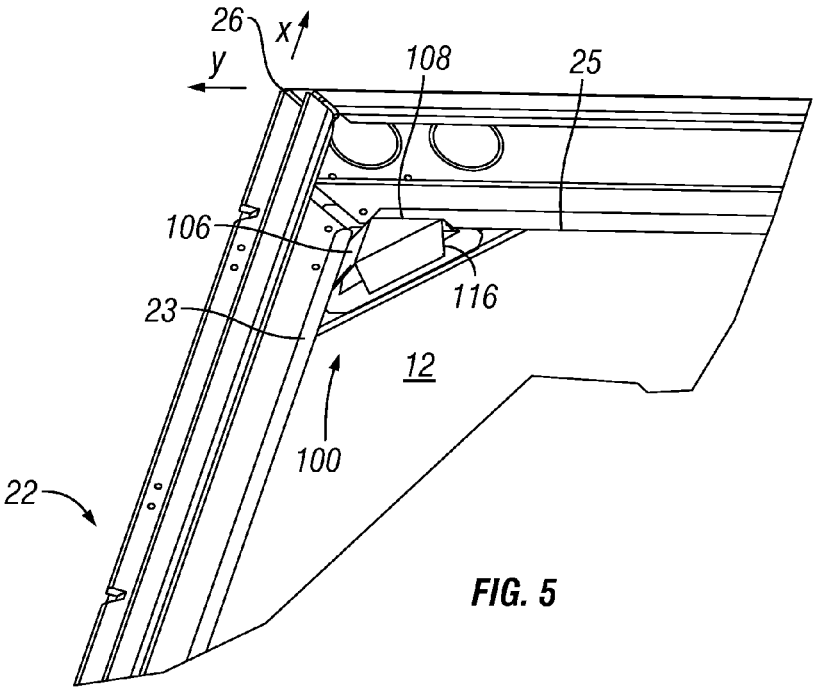
FIG. 5 is a view of the position of a first embodiment of the stacking bracket mounted on a bottom HVAC unit relative to a base rail of a top HVAC unit, wherein only the base rail of the top HVAC unit is shown for clarity.

Referring to FIGS. 4 and 5, the top unit 20 may be stacked on top of the bottom unit 10 to position the stacking insert 104 within the perimeter of a base rail 22 of the top unit 20. The sloped surfaces 106, 108 of the stacking insert 104 may be positioned adjacent to inner walls 23, 25 of the base rail 22 of the top unit 20.

Figure 6:
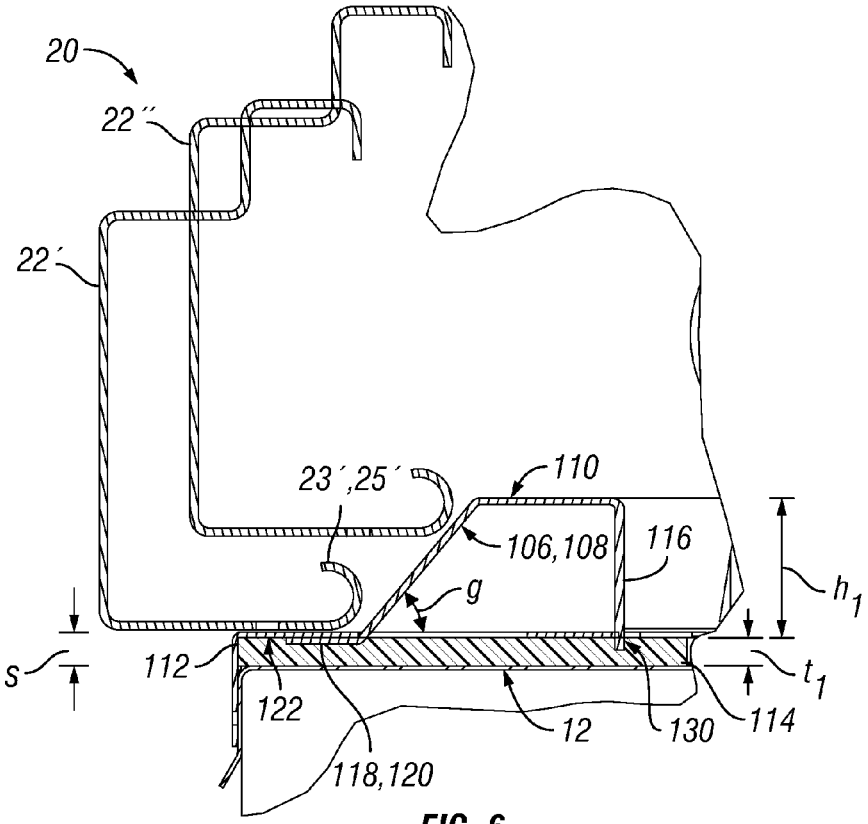
FIG. 6 is an illustration of a cross-sectioned view of a first embodiment of the stacking bracket mounted on a bottom HVAC unit showing the position sloped surfaces of the first embodiment of the stacking bracket relative to a base rail of a top HVAC unit in a first and second position.

Referring to FIGS. 5 and 6, the sloped surfaces 106, 108 may resist disengagement of the top unit 20 from its stacked configuration, when the top unit 20 is rocked or bumped to disturb its placement on the bottom unit 10. In the embodiment shown in FIG. 5, the sloped surfaces 106, 108 are positioned adjacent to the corner 26 formed by a base rail 22 of the top unit 20.

As shown in FIG. 6, the top unit 20 may be rocked due to a disturbance force applied to the top unit 20, as may be experienced during transport of the top unit 20. This disturbance force may cause a portion of the base rail 22', shown in a first original position, to lift above the top cover 12. FIG. 6 also shows the base rail 22" in a second disturbed position.

As shown in FIGS. 1 and 6, the top surface 122 of the base member 102 may extend around at the base portion of the sloped surfaces 106, 108, where the sloped surfaces 106, 108 meet the top surface 122, to provide a surface for the base rail 22' to rest on in the original position or for the rail 22" to come to rest to from the disturbed position. The top surface 122 be substantially flat and may extend in a plane substantially parallel to the HVAC top surface, when the base member is mounted to the HVAC top surface of the bottom unit. It will be understood that the top surface 122 may have other configurations, e.g. a cupped or bowl surface, for promoting stability of the stacked configuration of the top unit 20 on the bottom unit 10.

The sloped surfaces 106, 108 may function as a ramp or an impact surface or both. Because of the proximity of the walls 23', 25' of the base rail 22 to the sloped surfaces 106, 108, the base rail walls 23', 25' may impact, recoil from, or ride up and along the sloped surfaces, when the top unit is rocked or bumped by the disturbance force. The weight of the top unit and the inclination of the sloped surfaces 106,108 may impede upward movement of the base rail 22" causing the top unit 20 to slide down the sloped surfaces 106, 108 and back toward the original stacked configuration, for example the position of base rail 22' in the first original position.

Figure 7A:
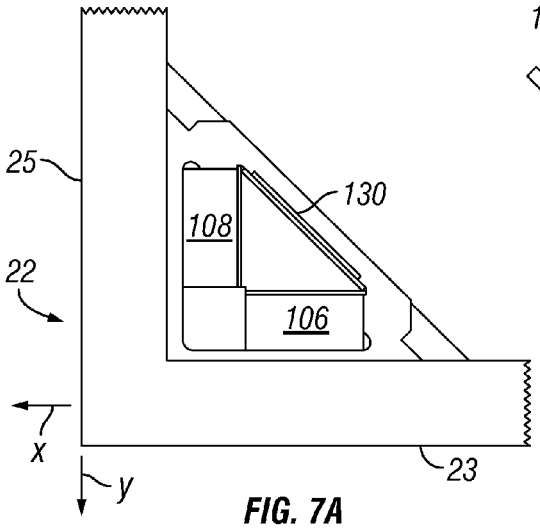
FIGS. 7A and 7B are a top view and a back view of a first embodiment of the stacking bracket, respectively, wherein the top view (FIG. 7A) shows the position of a base rail of a top HVAC unit relative to sloped surfaces of the first embodiment of the stacking bracket.

Referring to FIG. 6, the sloped surfaces 106, 108 may be configured substantially to face an adjacent portion of the walls 23, 25 of the base rail 22. The sloped surfaces 106 and 108 may comprise a general wedge shape. As shown in FIGS. 5 and 7A, each sloped surface 106 and 108 may extend in a direction parallel to a respective adjacent portion of the base rail 22. Sloped surface 106 may extend in a direction x parallel to first wall 23, and sloped surface 108 may extend in a direction y parallel to second wall 25.

As shown in FIG. 6, the sloped surfaces 106, 108 may comprise a sloped profile. In some embodiments, the slope is constant extending at an angle g, relative to the top cover 12. The slope may comprise a range from about 30 to 70°.

Figure 8:
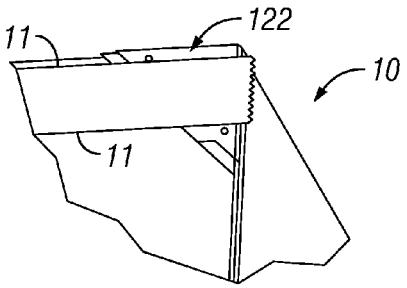
FIG. 8 is an illustration of the position of a strap used to secure a bottom HVAC unit to a flatbed truck relative to a first stacking bracket that is mounted to the bottom HVAC unit.

In some embodiments, the first insert 104 may be removable to allow for the use of straps to secure the bottom unit 10 to a flatbed truck. Referring to FIG. 8, a strap 11 may lie cross along at least a portion of the top surface 122 of the base member 102. Removing the insert 104 allows the straps to lie across a substantially flat surface across the top of the base member 102 that provides substantially a continuous flat surface across the top cover 12 of the bottom unit 10.

The Stacking Bracket 100

Referring to FIGS. 1, 2, and 3B, the base member 102 of the first stacking bracket 100 may comprise an upper base portion 112 and a lower base portion 114. The first insert 104. The first insert 104 may further comprise a brace member 116, extending from the top 110, and mounting tabs 118, 120 extending from a bottom part of the sloped surfaces 106, 108. The sloped surfaces 106, 108 are inclined relative to the mounting tabs 118, 120 and are configured to be inclined relative to the top cover 12 of the bottom unit 10 and the top surface 122, when the first stacking bracket 100 is mounted to the bottom unit 10.

Figure 3A:
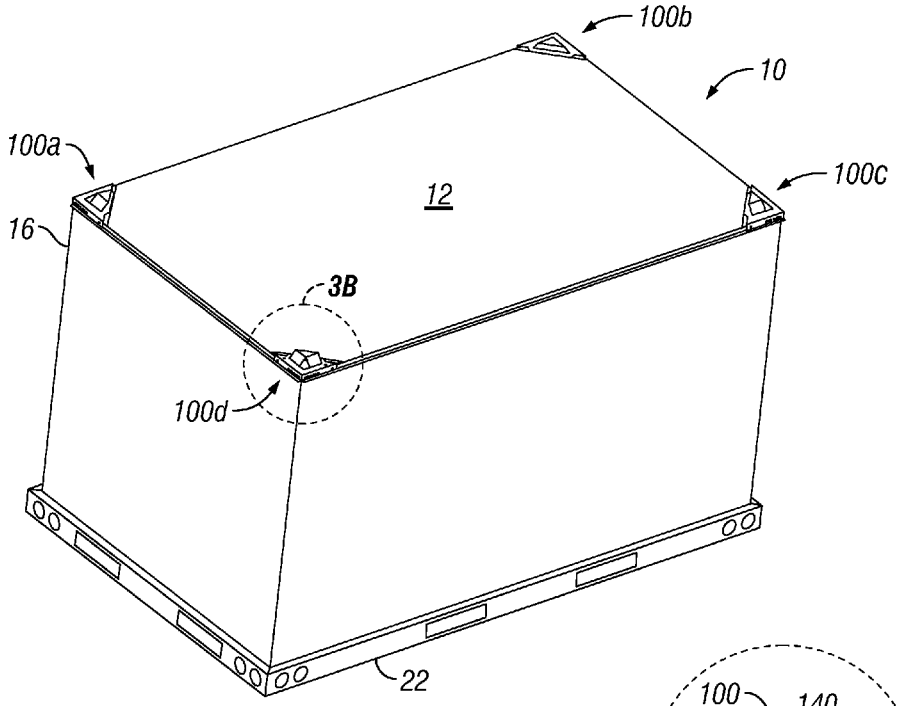
FIGS. 3A and 3B are a perspective view and detailed view, respectively, of a first embodiment of the system of stacking brackets mounted on four upper corners of a bottom HVAC unit.
Figure 3B:
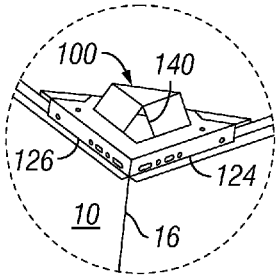

Referring to FIGS. 1, 2 and 3A, the upper base portion 112 comprises a size and shape configured to fit over a corner 16 of the bottom unit 10. In the embodiment shown, the upper base portion 112 may form a triangular wedge shape that has a top surface 122 that fits on top of the top cover 12 of the bottom unit 10 and that has flanges 124, 126 that extend over side surfaces of the bottom unit 10 (as shown in FIGS. 3A and 3B). The top surface 122 and the flanges 124, 126 may protect corners (e.g. corner 16) of the bottom unit 10 and prevent damage to the top unit 20.

In some embodiments, as shown in FIG. 1, each flange 124, 126 may comprise a flange length $l_1$. The flanges 124, 126 may be configured symmetrically to have the same length $l_1$. The length $l_1$ may comprise 6 with a range of about 3-14 in (depending on the size of the product). It will be understood by persons of ordinary skill in the art that the length $l_1$ may be varied to vary the area that the first stacking bracket 100 covers on the top cover 122 of the bottom unit 10.

Referring to FIGS. 1 and 2, the top surface 122 of the upper base portion 112 may comprise a first hole 128 extending through the top surface 122. The first hole 128 may comprise a size and shape configured to receive a portion of the first insert 104. The upper base portion 112 further comprises a brace slot 130 configured to receive a portion of the brace member 116 of the first insert 104.

Referring to FIGS. 2 and 6, the lower base portion 114 may comprise a flat member configured to be positioned between the top surface 122 of the upper base portion 112 and the top cover 12 of the bottom unit 10. The shape of the lower base portion 114 may have a similar triangular wedge shape to fit within the top surface 122 and flanges 124, 126 of the upper base portion 112.

Referring to FIGS. 2 and 6, the lower base portion 114 may have a thickness $t_1$ configured to provide separation s between the bottom of the base rail 22 of the top unit 20 and the top cover 12 of the bottom unit 10. The separation s includes the thickness of the top surface 122. The thickness $t_1$ providing the separation s also accounts for flexing and bending of the base rail 22 that occurs due to the weight of the top unit 20 when it is stacked on the bottom unit 10. In some embodiments, the thickness $t_1$ may comprise 0.3 inches (in.) with a range of about 0.25 in.-about 1.25 in., and the separation s may comprise 0.345 in. with a range of about 0.03-about 1.25 in. It will be understood by persons of ordinary skill in the art that the thickness $t_1$ and the thickness of the top cover 122 can be varied to vary the separation s.

Referring to FIGS. 1, 2, and 6, the first stacking bracket 100 may be assembled and mounted to the bottom unit 10 by placing the top 110, brace member 116, and sloped surfaces 106, 108 of the first insert 104 through the first hole 128 to extend above the top surface 122 of the upper base portion 112. The mounting tabs 118, 120 are positioned under the top surface 122, and the brace member 116 is inserted into the brace slot 130.

Referring to FIGS. 1, 5, 6, and 7B, the brace member 116 may comprise a tapered shape to allow a bottom portion of the brace member 116 to wedge into the brace slot 130 to secure the brace member 116. As shown in FIG. 6, the sloped surfaces 106, 108 may extend above the top surface 122 to a height $h_1$. The height $h_1$ may comprise about 1.5 in. within a range of about 1.5-3.0 in.

The wedging of the brace member 116 in the slot 130 may be configured to support the sloped surfaces 106, 108 at about the same height $h_1$. The brace member 116 may further prevent the first insert 104 from being crushed and it may lock the first insert 104 in place to prevent unintended removal.

Figure 7B:
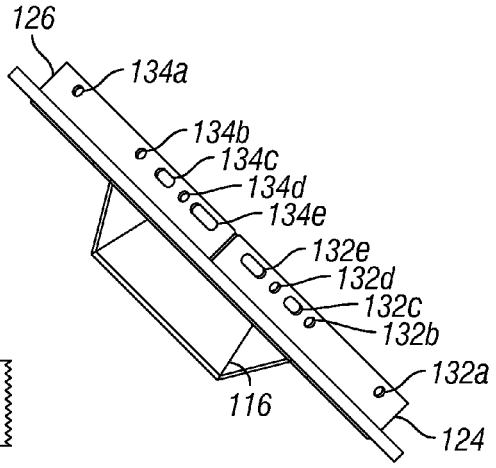

Referring to FIGS. 4, 6, and 7B, the lower base portion 114 may be fit under top surface 122 so that the lower base portion 114 makes contact with the mounting tabs 118, 120. These parts of the first stacking bracket 100 may be placed onto a first corner 16 of the bottom unit 10. One or more fastener apertures 132*a-e* and 134*a-e* extending along the flanges 124 and 126, respectively, may align with apertures (not shown) in the side surfaces of the bottom unit 10. Fasteners, such as screws 27*a-c* and 24*a-c*, may pass through the one or more fastener apertures 132*a-e* and 134*a-e*, respectively, to threadably engage the apertures in the side surfaces to secure the first stacking bracket 100 to the bottom unit 10.

Referring to FIG. 6, securing the first stacking bracket 100 to the bottom unit 10 may compress the lower base portion 114 and the mounting tabs 118, 120 between the top surface 122 of the upper base portion 112 and the top cover 12. This compression may align the mounting tabs 118,120 in parallel with the top cover 12 and position the sloped surfaces 106, 108 so that the slope surfaces 106, 108 extend from the top surface 122 at an angle g relative to the top cover 12.

Referring to FIGS. 1 and 6, the lower base portion 114 may be held in place by nail pierce protrusions 136, 138 which extend downward from the top surface 122 of the upper base portion 112 to make contact with the lower base portion 114. These protrusions may be formed by piercing the top surface with a hole punch.

In some embodiments, the lower base portion 114 is made of corrugated plastic. The compressible surfaces of the corrugated plastic allows the protrusions 136, 138 of the nail pierce to sink the upper surface of the lower base portion 114 increasing the resistance of the lower base portion to sliding or displacement, when the first stacking bracket 100 is mounted to the bottom unit 10. It will be understood by persons of ordinary skill in the art that other suitable materials may be used for the lower base portion 114, for example cardboard.

In some embodiments, the upper base portion 112 and the first insert 104 may be made from sheet metal. It will be understood by persons of ordinary skill in the art that other suitable materials may be used for the upper base portion 112 and the first insert 104, for example other metals, plastics or composite materials.

In some embodiments, the first insert 104 is configured for removal to support using straps to secure the bottom unit 10 to a flatbed truck. Referring to FIG. 3B, a lever device (not shown), such as claw hammer or screwdriver, may be positioned within a gap 140 between the sloped surfaces, 106, 108 to pry the brace member 116 from the brace slot 130 (shown in FIG. 6) while the first stacking bracket 100 is mounted to the bottom unit 10. The first insert 104 may be manually removed from its connection to the upper base portion 112 by pulling the first insert 104 so that the mounting tabs 118, 120 slide out from under the top surface 122. The first insert 104 may be discarded or re-used.

Referring to FIG. 8, removal of the first insert 104 detaches the sloped surfaces 106, 108 from the top surface 122, and removes the first insert 104 as an obstruction in the plane in which the top surface 122 extends. With the sloped surfaces 106, 108 detached, the top surface 122 may extend in an uninterrupted, continuous plane to provide a substantially flat surface to receive a strap 11 on portions of the top surface 122 for securing the bottom unit 10.

As shown in FIGS. 3A and 4, one or more first stacking brackets 100*a-d* may be used in combination as part of a system to support stacking of the bottom unit 10 on the top unit 20. As shown in FIG. 3A, each first stacking bracket 100*a-d* is mounted on each of the four corners of the top cover 12 of the rectangular-shaped bottom unit 10. The first stacking brackets 100*a-d* may have substantially the same configuration relative to the rail 20 of the top unit 20, as described for first stacking bracket 100 in FIGS. 1, 2, 5, 6, 7A, and 7B.

In the system shown in FIGS. 3A and 4, the stacking insert 104 of each stacking bracket 100*a-d* may be positioned within the perimeter of the base rail 22 so that each stacking bracket 100*a-d* is supporting a portion of the base rail 22 in the manner described above (e.g. as shown in FIG. 5). Having the same configuration allows the first stacking brackets 100*a-d* to work in combination to resist disengagement of the top unit 20 from its stacked configuration, when the top unit 20 is rocked or bumped to disturb its placement on the bottom unit 10.

The Stacking Bracket 200

Figure 9:
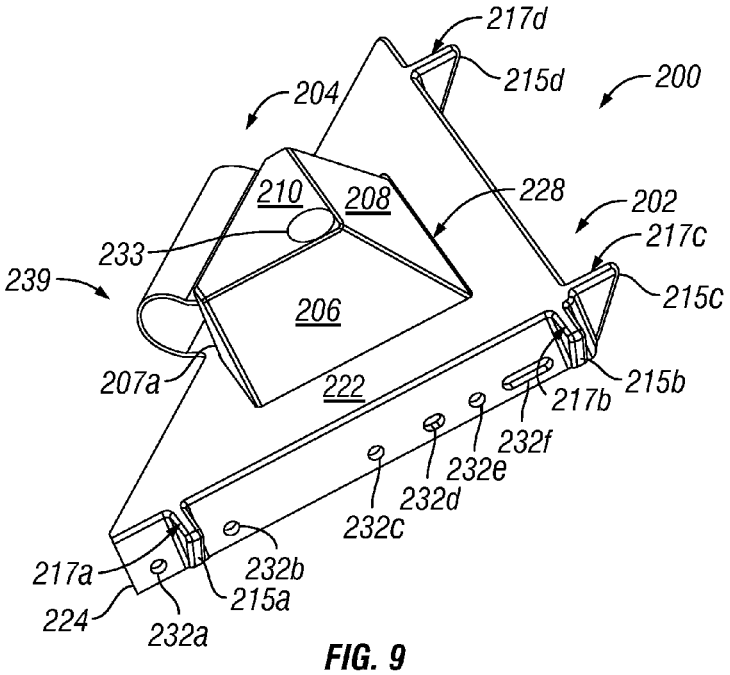
FIG. 9 is a perspective view of a second embodiment of the stacking bracket.

FIG. 9 illustrates a second embodiment of a stacking bracket for stacking the top unit 20 on the bottom unit 10. A second stacking bracket 200 may replace, as an alternative, the first stacking bracket 100 in the configurations shown in FIGS. 3A and 4.

Referring to FIG. 9, the second stacking bracket 200 may comprise some similar features as the first stacking bracket 100, shown in FIGS. 1 and 2. Second stacking bracket 200 may comprise a second insert 204 coupled to a second base member 202. In a manner similar to the first stacking bracket 100, the second insert 204 may comprise sloped surfaces 206, 208 inclined relative to a top surface 222 of the base member 202. The second stacking insert 200 may further be used as part of the system shown and described in Figure FIGS. 3A and 4.

Figure 10:
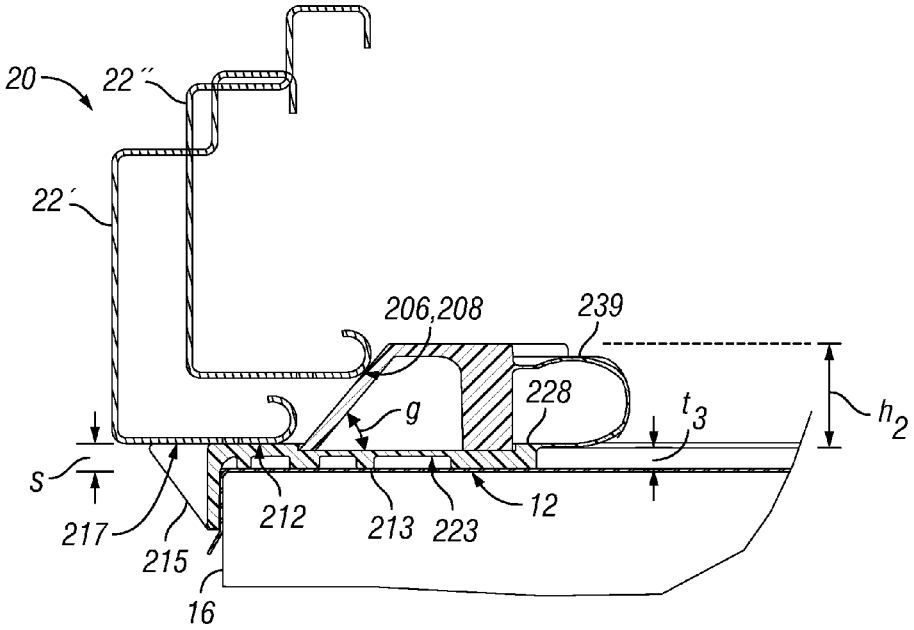
FIG. 10 is a cross-sectional view of a second embodiment of the stacking bracket mounted on a bottom HVAC unit showing the position sloped surfaces of the second embodiment of the stacking bracket relative to a base rail of a top HVAC unit in a first and second position.
Figure 11:
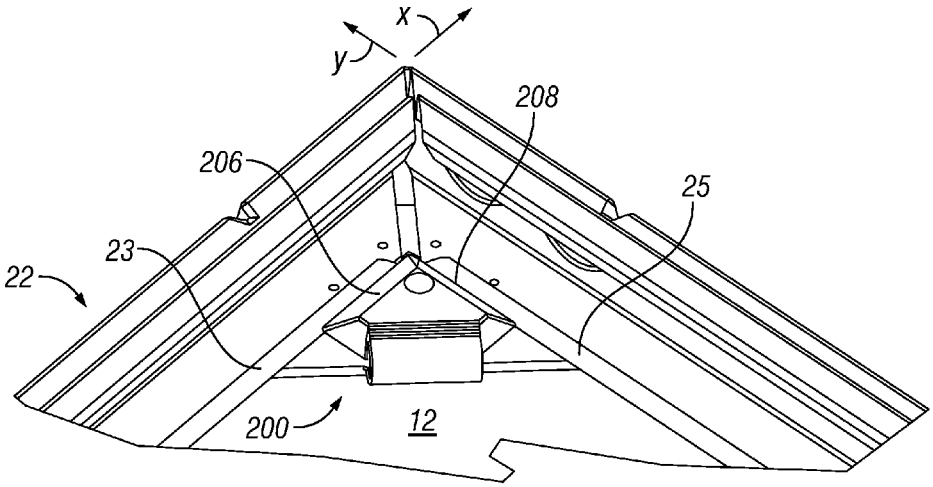
FIG. 11 is a view of the position of a second embodiment of the stacking bracket mounted on a bottom HVAC unit relative to a base rail of a top HVAC unit, wherein only the base rail of the top HVAC unit is shown for clarity.

Referring to FIGS. 10 and 11, the top unit 20 may be rocked due to a disturbance force applied to the top unit 20, as may be experienced during transport of the top unit 20. This disturbance force may cause a portion of the base rail 22', shown in a first original position, to lift above the underlying surface of the bottom unit 10. FIG. 10 shows the base rail 22" in a second disturbed position.

Referring to FIG. 10, the sloped surfaces 206, 208 may resist disengagement of the top unit 20 from its stacked configuration, when the top unit 20 is rocked or bumped to disturb its placement on the bottom unit 10. The sloped surfaces 206, 208 may function as a ramp or an impact surface or both, in a manner similar to that described for the first stacking bracket 100. As shown in FIG. 10, the sloped surfaces 206, 208 may extend above the top surface 222 to a height $h_2$. The height $h_2$ may comprise about 1.5 in. within a range of about 1.5-3.0 in.

In a manner substantially similar to that described for the first stacking bracket 100, the sloped surfaces 206, 208 of the second stacking bracket 200 may function as a ramp or an impact surface or both. Because of the proximity of the walls 23, 25 of the base rail 22 to the sloped surfaces 206, 208, the base rail walls 23, 25 may impact, recoil from, or ride up and along the sloped surfaces, when the top unit is rocked or bumped by the disturbance force. The weight of the top unit 20 and the inclination of the sloped surfaces 206,208 may impede upward movement of the base rail 22" causing the top unit 20 to slide down the sloped surfaces 206, 208 and back toward the original stacked configuration, for example the position of base rail 22' in the first original position. The base rail 22" may comprise a rolled-up portion, which may further promote sliding movement of the base rail 22", when the base rail 22" is in the disturbed position.

The base rail 22', in the original or at rest position, rests on the top surface 122. The length of the portion of the top surface 122 may provide further surface area for the base rail 22' to slide and react to a disturbance force, which may dissipate energy from rocking or bumping of the top unit 20 in a non-damaging manner.

Referring to FIG. 11, the sloped surfaces 206, 208 may be configured substantially to face an adjacent portion of the walls 23, 25 of the base rail 22. The sloped surfaces 206 and 208 may comprise a general wedge shape. Each sloped surface 206 and 208 may extend in a direction parallel to a respective adjacent portion of the walls 23, 25 of the base rail 22. Sloped surface 206 may extend in a direction x parallel to first wall 23, and sloped surface 208 may extend in a direction y parallel to second wall 25.

As shown in FIG. 10, the sloped surfaces 206, 208 may comprise a sloped profile. In some embodiments, the slope is constant extending at an angle g, relative to the top cover 12. The slope angle g may comprise a range from about 30 to 70°. The sloped surfaces 206, 208 may function in a similar manner as the sloped surfaces 106, 108 of the first stacking bracket 100, described above, as a ramp or an impact surface or both.

Figure 12:
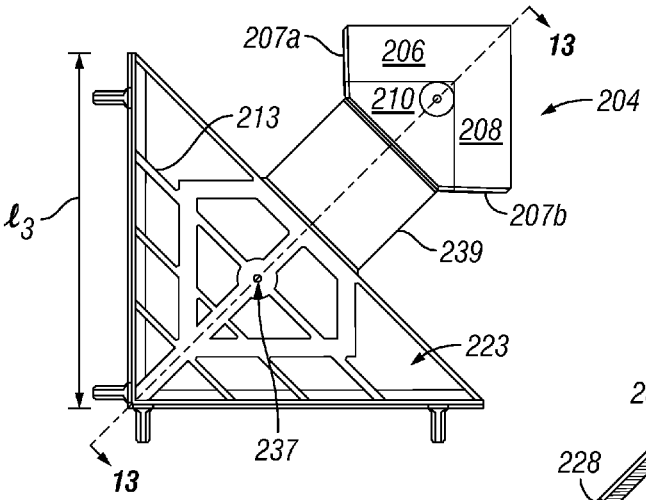
FIGS. 12 and 13 are a bottom view and a cross-sectional view taken along line 13-13 of the bottom view, respectively, of a second embodiment of the stacking bracket.

Referring to FIGS. 9, 11, and 12, the second insert 204 may comprise a top surface 210 having the sloped surfaces 206, 208, side surfaces 207*a* and 207*b*, and a back surface 216 extending from the edges of the top surface 210 towards a top surface 222 of the second base member 202. These side surfaces 207*a*, 207*b* and back surface 216 comprise walls of generally uniform thickness that resist crushing or buckling of the second insert 204. It will be understood by persons of ordinary skill in the art that the thickness of the walls may be varied to match the needs for strength or that the second insert 204 may comprise a substantially solid piece of material to maximize strength.

The second base member 202 comprises a size and shape configured to fit over a corner of the bottom unit 10 in a similar manner shown for the first stacking bracket 100 in FIGS. 3A and 4. In the embodiment shown in FIGS. 9 and 11, the base member 202 may form a triangular wedge shape. The top surface 222 fits on corner 16 (shown in FIG. 10) of the top cover 12 of the bottom unit 10.

Flanges 224, 226 are configured to extend over side surfaces of the bottom unit 10, in a manner similar to flanges 124, 126 of the first stacking bracket 100, shown in FIG. 3B. The top surface 222 and the flanges 224, 226 may protect corners of the bottom unit 10 and prevent damage to the top unit 20. The flanges 224, 226 may be configured symmetrically to have the same length $l_3$. The length $l_3$ may comprise 3.0 with a range of about 3.0-14 in.

Figure 13:
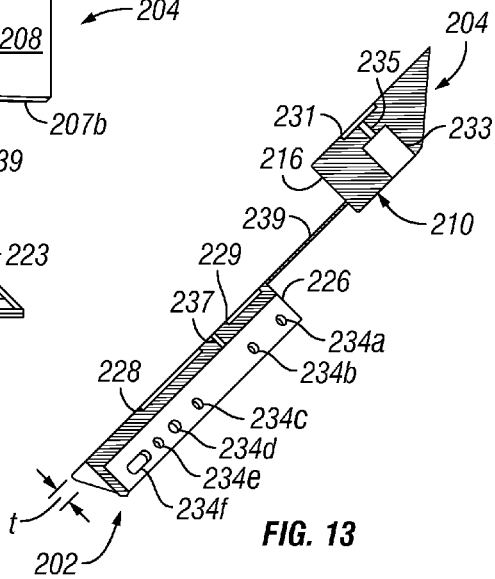

Referring to FIGS. 10, 12 and 13, an underside of the base member 202 may comprise ribbing 213 extending along an undersurface 223 opposite from the top surface 222. The ribbing 213 combined with the top surface 222 may comprise a thickness $t_3$ configured to provide separation s between the bottom of the base rail 22 of the top unit 20 and the top cover 12 of the bottom unit 10. The thickness $t_3$ providing the separation s also accounts for flexing and bending of the base rail 22 that occurs due to the weight of the top unit 20 when it is stacked on the bottom unit 10.

The ribbing 213 further may increase strength in high stress areas along the base member 202. It will be understood by persons of ordinary skill in the art that the thickness $t_3$, including the thickness of the top surface 222 and ribbing 213 may be varied to vary the separation s and to vary the loads that the base member 202 may bear.

The ribbing 213 may be utilized to save on materials, while at the same time increasing strength in high stress areas. In some embodiments, the underside of the base member 202 may be a uniform surface with no ribbing structure to maximize strength across the entire underside of the base member 202.

Referring to FIGS. 9 and 10, the base member 202 may further comprise support members 215*a-d*. In some embodiments, each support member 215*a-d* (illustrated as support member 215 in FIG. 10) may comprise substantially a triangle shape to form a brace structure. A top support surface 217 of each support member 215*a-d* may extend substantially from the side surface of the bottom unit 10, when the second stacking bracket 200 is mounted to the bottom unit 10. The length of each top support surface 217 is configured to support a portion of the base rail 22 of the top unit. As shown in FIG. 10, the support members each support member 215 may reduce stress on the top unit 20 by providing additional surface area along the top support surface 217 to bear the weight of the top unit 20 which is transferred through the rail 22', when stacked on the bottom unit 10.

The second stacking bracket 200 may be mounted to a bottom unit 10 in a manner similar to that as the first stacking bracket 100, as shown in FIGS. 3A and 4. The second stacking bracket 200 may be placed onto a first corner 16 of the bottom unit 10. Referring to FIGS. 9 and 13, one or more of fastener apertures 232*a-e* and 234*a-e* extending along the flanges 224 and 226, respectively, may align with apertures (not shown) in the side surfaces of the bottom unit 10. Fasteners, such as screws 24*a-c* and 27*a-c* (shown in FIG. 4), may pass through the one or more fastener apertures 232*a-e* and 234*a-e*, respectively, to threadably engage the apertures (not shown) in the side surfaces to secure the second stacking bracket 200 to the bottom unit 10.

Figure 14:
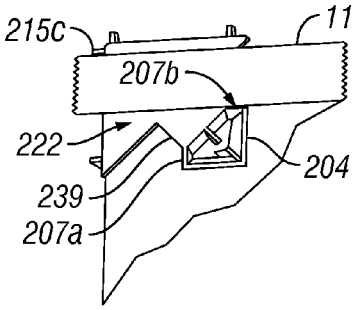
FIG. 14 is an illustration of the position of a strap used to secure a bottom HVAC unit to a surface, such as a flatbed truck, relative to a second embodiment of the stacking bracket that is mounted to the bottom HVAC unit.

Referring to FIGS. 12, 13, and 14, the second insert 204 may configured to be detachable from the top surface 222 of the base member 202 during use to support strapping the bottom unit 10 onto a flatbed truck. Detachment of the second insert 204 from the top surface 222 removes the second insert 204 as an obstruction to a strap 11 laid across the top surface 222, and provides for a more secure fit of the strap to the bottom unit 10.

Referring now to FIGS. 9, 10, and 13, the base insert 204 may be set into a first socket 228. The first socket 228 may comprise a recess in the top surface 222 of the base member 202. The first socket 228 may further comprise a perimeter having a shape configured to receive a bottom portion of the second insert 204. The shape of the perimeter may be substantially similar and be configured to fit closely with the bottom portion of the second insert 204 to prevent the second insert 204 from sliding along the top surface 222.

Referring to FIG. 13, a boss 229 may extend from the bottom surface of the impression of the first socket 228. The boss 229 may be configured to mate with a second socket 231 set in an under side of the second insert 204. The boss 229 and second socket 231 may prevent the second insert 204 from sliding along the top surface 222. A fastener aperture 237 may pass through at least a portion of the boss 229.

Referring to FIGS. 9 and 13, the second insert 204 may further comprise a third socket 233 comprising a recess in the top surface 210 of the second insert 204. The third socket 233 may comprise a depth and width to accommodate insertion of tools for insertion, actuation, or removal of a fastener, such as accessing a screw or bolt head. A fastener channel 235 may extend between the third socket 233 and the second socket 231 to allow a portion of a fastener, such as a screw or bolt, to pass from the top surface 210 of the second insert 204 to the boss 229.

When the second insert 204 is set into the first socket 228, the boss 229 and the second socket 231 will mate and align. The fastener channel 235 and the fastener aperture 237 will also align. A fastener (shown in FIG. 16B), such as a metal or plastic screw, may be passed into the fastener channel 235. A bottom surface of the third socket 233 may catch a head portion of the fastener 246 and be tightened against it to secure the second insert 204 to the second base member 202.

Referring to FIGS. 12, 13, and 14, the second insert 204 may be detached from the top surface 222 of the second base member 202 by loosening and removing the fastener (not shown). A socket wrench or a screwdriver may be inserted into the third socket 233 to remove the fastener.

In some embodiments, the second insert 204 may remain attached to the second base member 202 even after it is removed from the top surface 222. A hinge 239 may couple the second insert 204 to the second base member 202. The hinge 239 may comprise a band, strip or ribbon of flexible material extending between the second insert 204 and a portion of the second base member 202.

Referring to FIG. 14, the hinge 239 allows the second insert 204 to be removed from the top surface 222 to allow a strap to be set on the top surface 222. The hinge 239 may prevent the second insert 204 from being lost. The hinge 239 also allows the second insert 204 to be replaced and re-attached on the top surface 222 for re-use in stacking the top unit 20 on the bottom unit 10.

In some embodiments, the second base member 202, the second insert 204, and the hinge 239 are formed from the same material and may be formed as one continuous piece. For example, the stacking bracket 200 may comprise one piece of molded plastic, as shown in FIG. 13.

In some embodiments, the slope may change in a positive manner from the base of the sloped surface 206, 208 to the top of the second insert 204. For example, in FIGS. 15, 16A, and 16B, the sloped profile comprises a step change in slope from the first set of sloped surfaces 206, 208 to the second set of sloped surfaces, which are shown as extension sides 242*a, b, c*. The increase in slope from the first set to the second set of sloped surfaces increases the energy required to move the top unit 20 up and over the second insert 204, which may prevent disengagement of the top unit 20 from the bottom unit 10 during transport of the units 10, 20.

Figure 15:
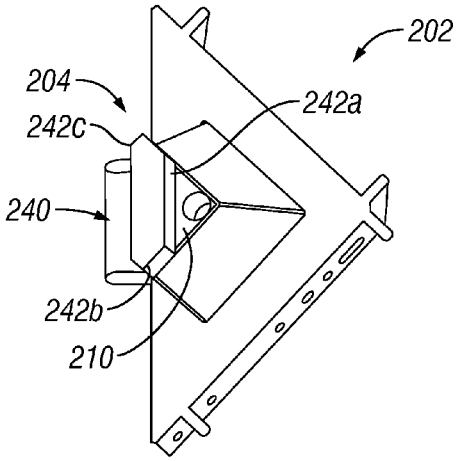
FIG. 15 is a perspective view of a second embodiment of the stacking bracket having an extended segment extending from a second insert.
Figure 16A:
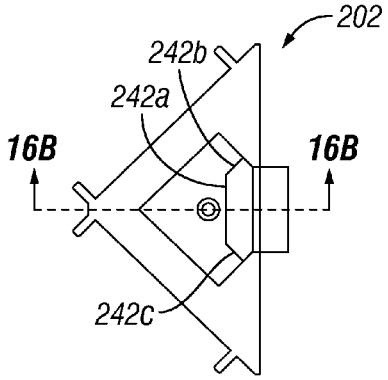
FIGS. 16A and 16B are a top view and a cross-sectional view taken along line 16A-16A shown in FIG. 16A of a second embodiment of the stacking bracket having an extended segment extending from a second insert.
Figure 16B:
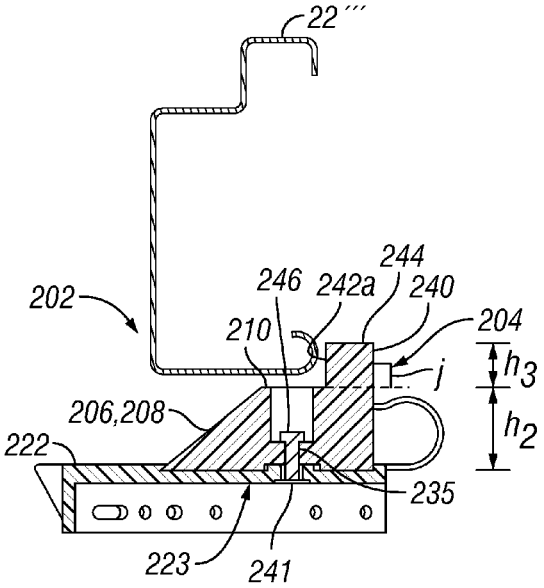

Referring to FIGS. 15, 16A, and 16B, the second insert 204 may further comprise an extended segment 240. The extended segment 240 may comprise a prismatic shape extending above the top surface 210 of the second insert 204 to a height $h_3$. The prismatic shape may be configured with the extension sides 242*a, b, c* having a slope (i.e. angle j) relative to the top surface 222 of the second base member 202 greater than the slope of the sloped surfaces 206, 208. In the embodiment shown, the extension sides 242*a, b, c* comprise a substantially vertical slope. It will be understood by persons of ordinary skill that the slope of the extension sides 242*a, b, c* may comprise a non-vertical slope (e.g. less than 90 degrees).

Referring to FIGS. 15, 16A, 16B, the sloped surfaces 206, 208 may resist disengagement of the top unit 20 from its stacked configuration, when the top unit 20 is rocked or bumped to disturb its placement on the bottom unit 10. The extension side surfaces 242*a, b, c* may function as a ramp or an impact surfaces or both, in a manner similar to that described for the sloped surfaces 206, 208.

The extension side surfaces 242*a, b, c* may have an added function of extending at a greater height above the underlying top surface 222 than the sloped surfaces 206, 208 to prevent disengagement of the top unit 20 from the bottom unit 10. For example in FIG. 16B, in response to a violent shock to the top unit 20, the rail 22''' may rise above the top surface 222 and impact the extension side surfaces 242*a, b, c*. The impact may cause the rail 22''' to recoil and return to the at-rest position shown in FIG. 10, showing the rail 22' in the at-rest position.

As shown in FIG. 10, the extension side surfaces 242*a, b, c* may extend above the top surface 222 to a height $h_3$ above the top surface 210 of the second insert 204 from a first surface 244. The height $h_3$ may comprise about 0.75 in. within a range of about 0.5-2.0 in. The extended segment 240 may be formed integrally from the same material as the second insert 204. In other embodiments, the extended segment may be removable and re-attachable from the second insert 204, or made from a different material.

In some embodiments, as shown in FIGS. 16A and 16B, the fastener 246 used to secure the second insert 204 to the second base member 202 may comprise a machine screw configured to threadably couple with a blind nut 241. The blind nut 241 may be secured to the undersurface 223 opposite from the top surface 222. The blind nut 241 may be pressed into the undersurface 223, which may comprise a plastic material. The machine screw may be driven in from the top through the fastener channel 235 and the fastener aperture 237, in the same manner described in FIG. 12A. In some embodiments, the blind nut 241 is configured to threadably couple with a 10-32 machine screw in place of a sheet metal or plastic screw. The blind nut 241 may be recessed into the plastic of the undersurface 223 to prevent damage to the top surface 222.

Referring to FIG. 14, the support members 215*a-d* and the side surfaces 207*a* and 207*b* of the second insert 204, when the second insert 204 is in the unfolded position, may aid in locating and locking the strap in place on the top surface 222 to prevent slipping or sliding of the strap along the top surface 222. For example, one side of strap may contact a portion of the support member 215*c* and another side of the strap may contact the side surface 207*c*.

The Stacking Bracket 300

Referring to FIGS. 17-24, a third embodiment of a stacking bracket for stacking the top unit 20 on the bottom unit 10 is shown. The third stacking bracket 300 may be used for stacking a top unit 20 on top of a bottom unit 10 in a manner similar to that described above and in reference to the first stacking bracket 100 and second stacking bracket 200. The third stacking bracket 300 may aid in locating the top unit 20 as it is stacked on the bottom unit 10, and may, further, resist sliding movement of the top unit 20 relative to the bottom unit 10 in response to disturbance forces. Further, the third stacking bracket 300 may be used as part of a system similar to that shown and described in FIGS. 3A and 4 in reference to the first stacking bracket 100 and the second stacking bracket 200.

As described herein, the third stacking bracket 300 may comprise, generally, a base member portion and a raised insert portion. The raised insert portion may further comprise a ramp section and a vertical extension. The base member portion of the third stacking bracket 300 may have features, characteristics, and functions similar to those of the base member 102 of the first stacking bracket 100 and the base member 202 of the second stacking bracket 200, as described above. Further, the raised insert portion of the third stacking bracket 300 may have some features, functions, and characteristics similar to those of the second insert 204 of the second stacking bracket 200, as described above.

Figure 17A:
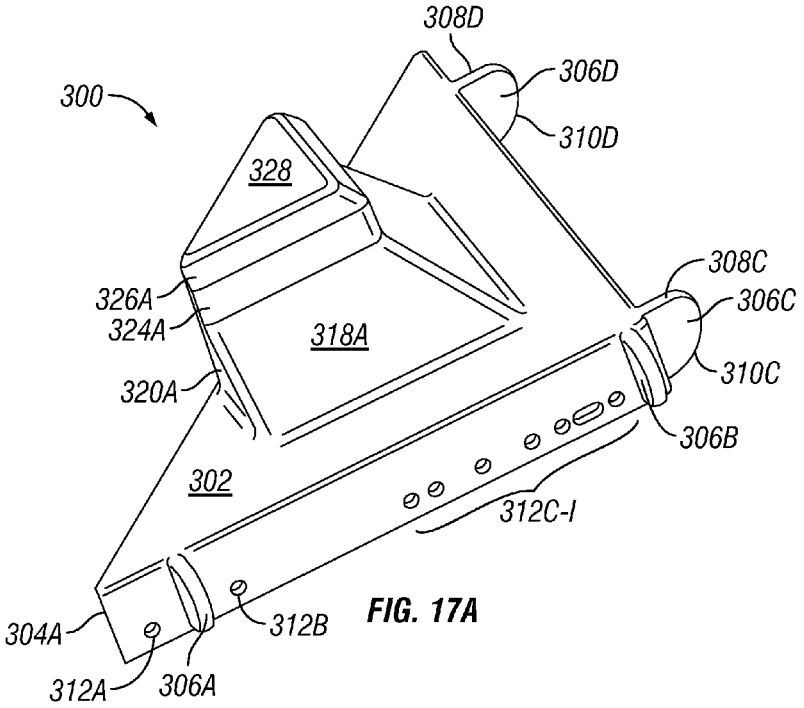
FIG. 17A is a first perspective view of a third embodiment of the stacking bracket.
Figure 17B:
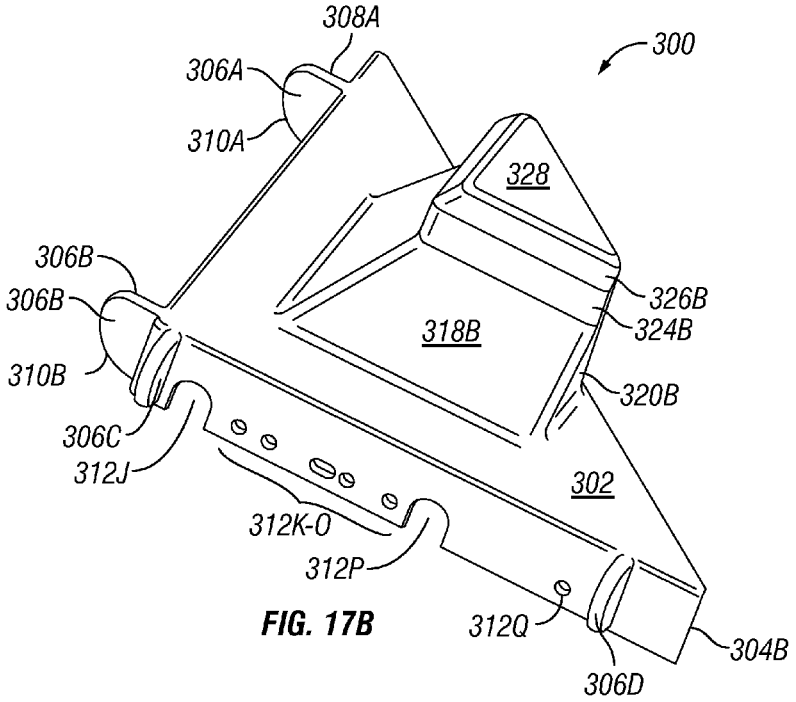
FIG. 17B is a second perspective view of a third embodiment of the stacking bracket.

The third stacking bracket 300 may be comprised of a rigid material, or materials. Referring to FIGS. 17A and 17B, in an embodiment, the third stacking bracket 300 may comprise a single piece of material. For example, the third stacking bracket 300 may comprise a single piece of a molded plastic material. It will be understood by persons of ordinary skill in the art that, in alternative embodiments, the third stacking bracket 300 may comprise of any other suitable material, such as metal, composite, plastic, and the like, which may be capable of performing some, or all, of the functions of the third stacking bracket 300, as described herein.

In an embodiment, the third stacking bracket 300 may comprise of walls having a uniform material thickness. Alternatively, in an embodiment, the third stacking bracket 300 may comprise of one, or more, walls configured with different thicknesses from one, or more, other walls. It will be understood by persons of ordinary skill in the art that that the thickness of the third stacking bracket 300 walls may vary in accordance with design considerations such as strength and load bearing capacity of the third stacking bracket 300, the resistance to deformation of the third stacking bracket 300, the desired spacing between the stacked units 10, 20 provided by the third stacking bracket 300, and the like.

Figure 19:
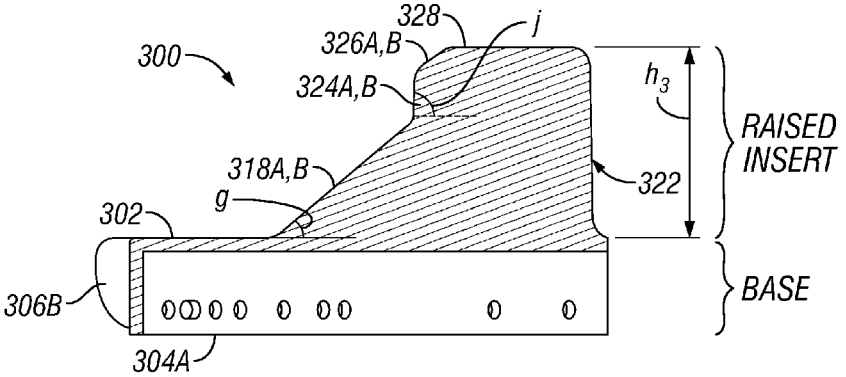
FIG. 19 is a sectional view of a third embodiment of the stacking bracket along line 3-3 of FIG. 18.
Figure 21A:
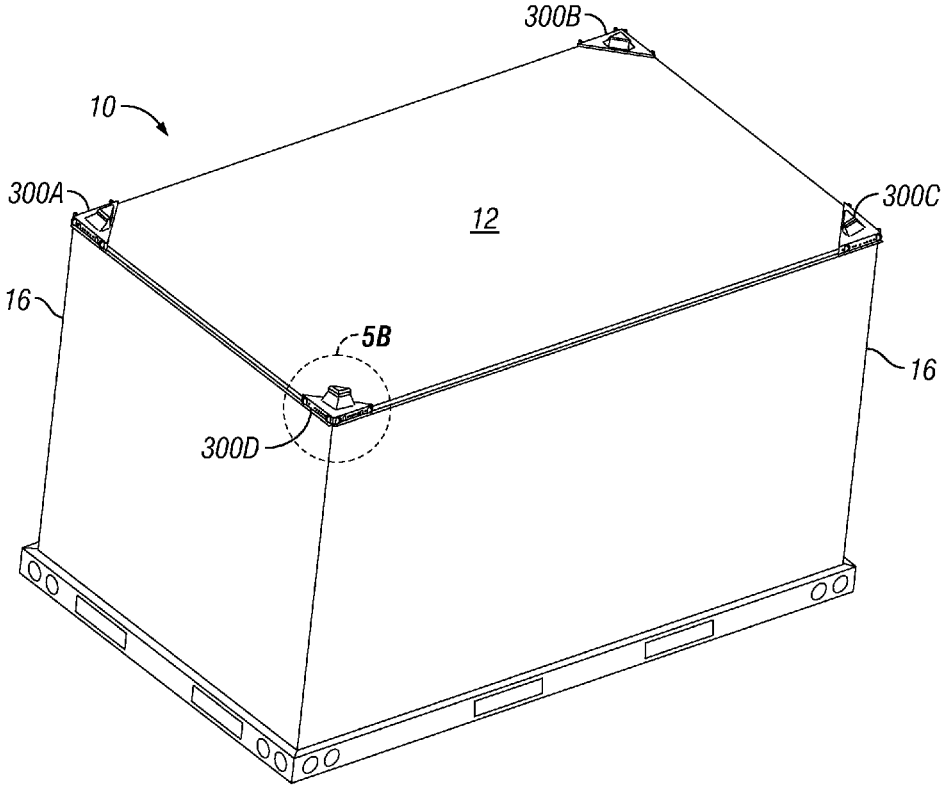
FIG. 21A is a view of a third embodiment of the stacking bracket coupled to a bottom unit 10.
Figure 21B:
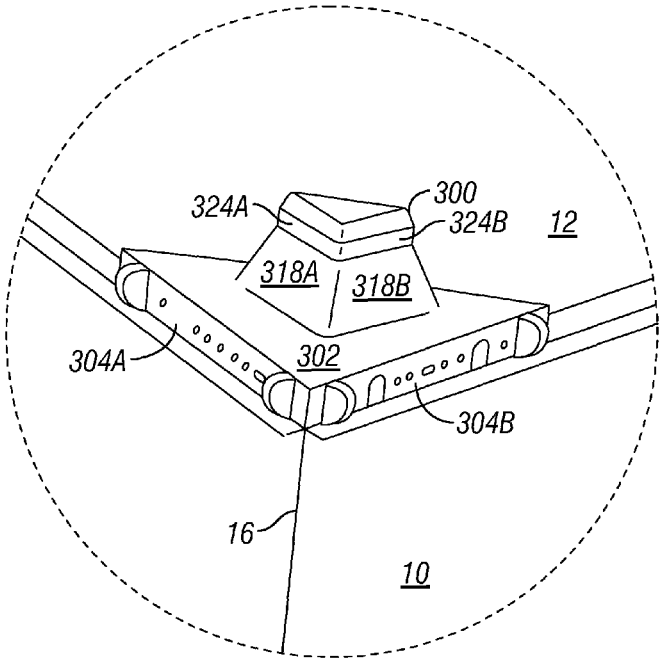
FIG. 21B is a detail view of a third embodiment of the stacking bracket coupled to the bottom unit 10 at a corner 16.
Figure 22:
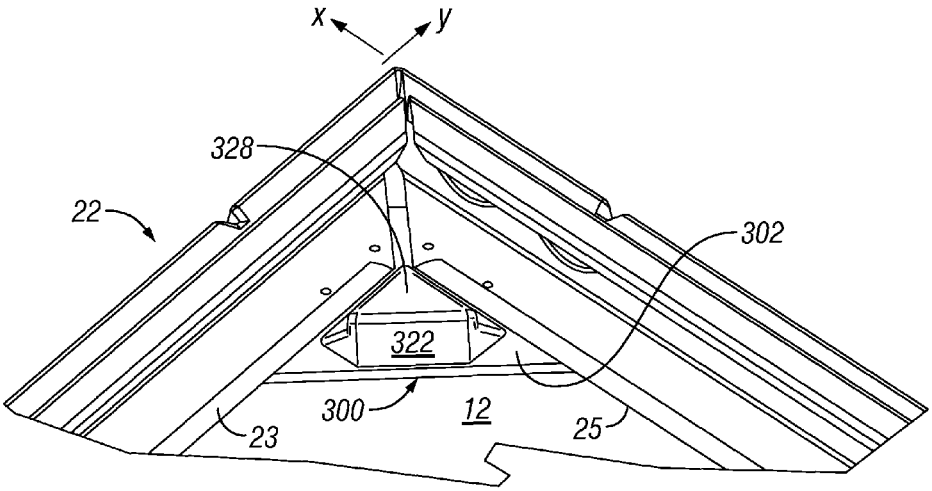
FIG. 22 is a view of a third embodiment of the stacking bracket and the base rail 22 of a top unit 20 in an undisturbed position.
Figure 23A:
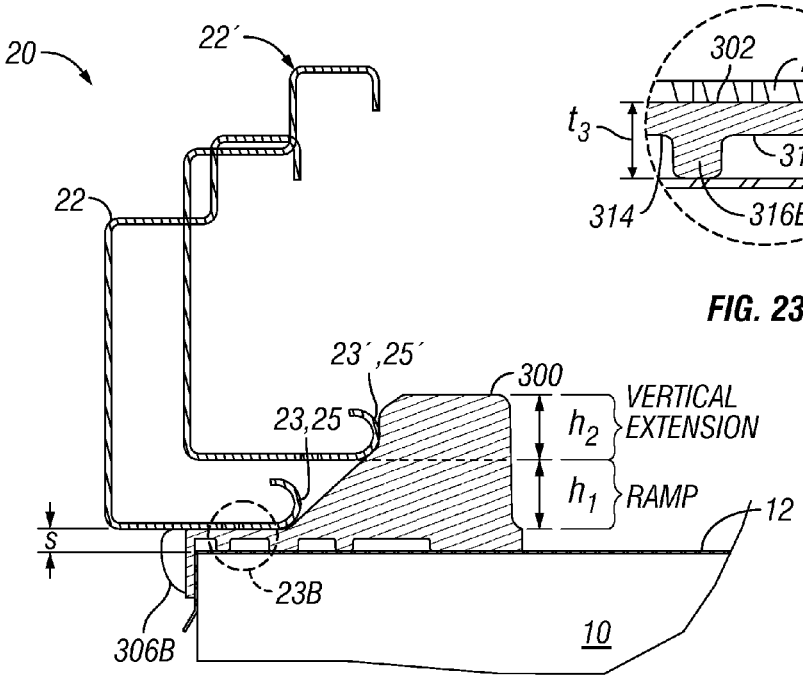
FIG. 23A is a view illustrating the position of the base rail 22 in the undisturbed position and in the disturbed position 22'.
Figure 24:
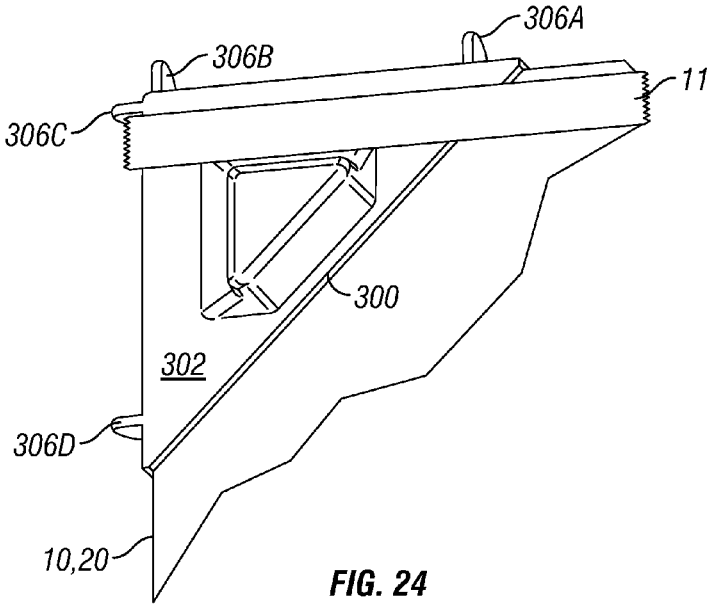
FIG. 24 is an illustration of the routing of the strap 11 over a third embodiment of the stacking bracket.

Referring to FIGS. 19, 22, and 23A, in an embodiment, the third stacking bracket 300 may include a base member portion (base, generally) for receiving the top unit 20 during stacking. The base member portion may receive a portion of the base rail 22 of the top unit 20, supporting the load of the top unit 20 while maintaining a desired spacing between the base rail 22 of the top unit 20 and the top cover 12 of the bottom unit 10. As shown in FIG. 21B, the base member portion may, additionally, receive one or more fasteners (not shown) for coupling the third stacking bracket 300 to the bottom unit 10. In an embodiment, as shown in FIG. 24, the base member portion may also be configured to constrain the position of the strap 11, which may be routed over the third stacking bracket 300. In alternative embodiments, the third stacking bracket 300 may be configured to perform some, or all, of these functions.

Figure 20:
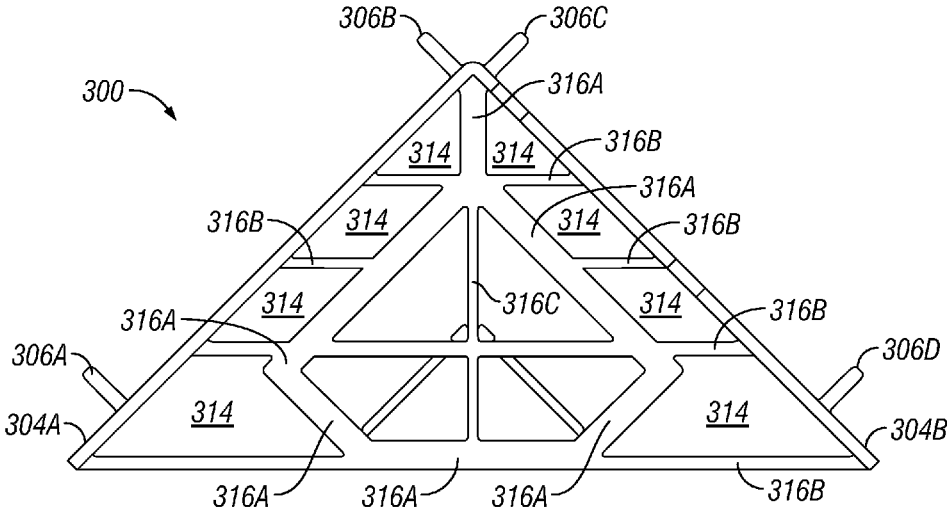
FIG. 20 is a bottom view of a third embodiment of the stacking bracket.

Referring to FIGS. 17A, 17B, and 20, in an embodiment, the base member portion of the third stacking bracket 300 may be provided with a top surface 302, a pair of flanges 304A, B, a plurality of support members 306A-D, and an undersurface 314. In alternative embodiments, the base member portion of the third stacking bracket 300 may be provided with more, or fewer, of the components than shown in the particular embodiment of FIGS. 17-24. Further, in alternative embodiments, the base member portion of the third stacking bracket 300 may be implemented with additional, fewer, or different components than those shown in the particular embodiment of FIGS. 17-24.

The top surface 302 of the third stacking bracket 300 may have similar features, functions, and characteristics as the top surface 222 of the second stacking bracket 200, as described above. Referring to FIGS. 17A, 17B, and 23A, the top surface 302 may receive a portion of the base rail 22 of the top unit 20 when the top unit 20 is stacked on the bottom unit 10 and is in an undisturbed position (as shown in FIG. 23A at the position of the base rail 22). The top surface 302 of the third stacking bracket 300 may support the load of the top unit 20. The top surface 302 may, further, provide a surface area upon which the top unit 20 may slide and react to a disturbance force, which may dissipate energy from rocking or bumping of the top unit 20 in a non-damaging manner.

As best shown in FIG. 23A, the top surface 302 may be substantially flat and may extend in a plane substantially parallel to the top cover 12 of the bottom unit 10 when the third stacking bracket 300 is coupled to the bottom unit 10. It will be understood by those skilled in the art that, in alternative embodiments, other configurations may be provided for promoting stability of the stacked configuration of the top unit 20 on the bottom unit 10. For example, in an alternative embodiment, the top surface 302 may comprise one, or more, curved surfaces arranged in a cupped, bowl, grooved, or other similar configuration. Alternatively, the top surface 302 may comprise one, or more, flat surfaces, with each flat surface oriented at an inclined angle relative to the top cover 12 of the bottom unit 10.

Figure 18:
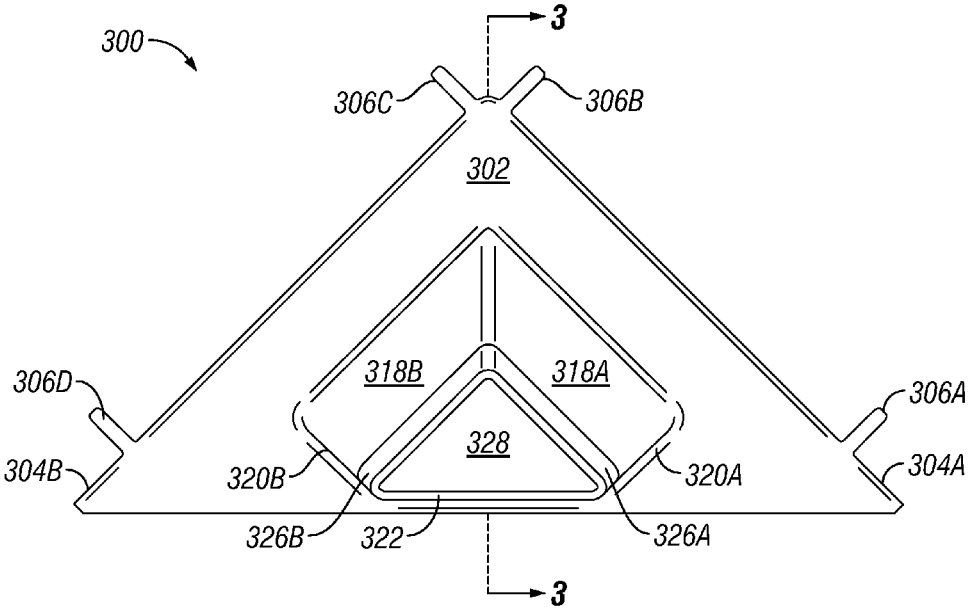
FIG. 18 is a top view of a third embodiment of the stacking bracket.

Referring to FIG. 18, in an embodiment, the top surface 302 may comprise a generally triangular wedge shape when viewed from above. In alternative embodiments, the top surface 302 may have a different shape. For example, in an embodiment, the top surface 302 may have a rectangular, trapezoidal, L, half circle, or other similar regular or irregular shape.

According to the particular embodiment shown in FIG. 18, the shape of the top surface 302 may be that of an isosceles triangle and may, further, be that of a right triangle. As shown in FIGS. 21A and 21B, the third stacking bracket 300 may be configured to couple to the bottom unit 10 at the corner 16. In such an embodiment, the top surface 302 may be provided with two equal-length sides, which may be about 7 inches in length. In alternative embodiments, the side lengths may be within a range of about 3 to 14 inches, with the specific length varying in correspondence with the size, and weight, of the units 10, 20. It will be understood by persons of ordinary skill in the art that the side lengths of the top surface 302 may be increased, or decreased, to configure the third stacking bracket 300 in response to the particular size, and weight, of the units 10, 20 to be stacked.

As shown in FIGS. 17A and 17B, in an embodiment, the third stacking bracket 300 may be provided with the flanges 304A, B. The flanges 304A, B of the third stacking bracket 300 may have similar features, functions, and characteristics as the flanges 224, 226 of the second stacking bracket 200, as described above. The flanges 304A, B may comprise substantially flat surfaces configured to contact portions of the side surfaces of the bottom unit 10 for setting the position of the third stacking bracket 300 when the stacking bracket is coupled to the bottom unit 10.

According to the embodiment shown, the flanges 304A, B may be substantially rectangular shaped walls disposed along the edges of the equal-length sides of the top surface 302. As shown in FIGS. 21A and 21B, the flanges 304A, B may be configured to contact adjacent side surfaces of the bottom unit 10, setting the third stacking bracket 300 location substantially at the corner 16 of the bottom unit 10.

The flanges 304A, B may have lengths substantially equal to the respective lengths of the sides of the top surface 302 from which the flanges 304A, B extend. The flanges 304A, B may each extend downward and away from the top surface 302 in directions that may be substantially normal to the plane of the top surface 302. The flanges 304A, B may be configured extend a distance, or height, along the side surfaces of the bottom unit 10 sufficient to "grip" the top cover 12 of the bottom unit 10. Further, the height of the flanges 304A, B may be sufficiently large to provide a surface for receiving fasteners for coupling the third stacking bracket 300 to the bottom unit 10, as described below. In an embodiment, the flanges 304A, B may have a height of about 1 inch. In alternative embodiments, the flanges 304A, B may have a height within the range of ½ to 3 inches.

As shown in FIGS. 17A and 17B, in an embodiment, the flanges 304A, B may be provided with the support members 306A-D. The support members 306A-D of the third stacking bracket 300 may have similar features, functions, and characteristics as those of the support members 215A-D of the second stacking bracket 200, as described above. As shown in FIGS. 21B and 23A, the support members 306A-D may comprise substantially vertical brace structures for receiving a portion of the base rail 22 of the top unit 20 and supporting the load of the top unit 20. The support members 306A-D may reduce stress concentrations in the base rail 22 of the top unit 20 by dispersing the load of the top unit 20 over a greater surface area. Additionally, or alternatively, the support members 306A-D may provide one, or more, barriers for constraining the location of the strap 11, as shown in FIG. 24. Further, the support members 306A-D may act as bumpers during movement and stacking of the units 10, 20, providing impact protection to the sides of the units 10, 20.

According to the embodiment shown in FIGS. 17A and 17B, the flange 304A may be provided with the support members 306A, B and the flange 304B may be provided with the support members 306C, D. In alternative embodiments, the flanges 304A and/or 304B may be provided additional, or fewer, of the support members 306 than shown. Further, in alternative embodiments, the support members 306 provided may be configured to perform fewer, or additional, functions than those described, herein.

As shown in FIG. 19, the support members 306A, B may each extend a distance outward, and away from, the surface of the flange 304A forming two substantially vertical brace structures. In an embodiment, the support members 306A, B may be configured to extend about 11/16 inches beyond the surface of the flange 304A. In alternative embodiments, the support members 306A, B may be configured to extend within a range of distances of between ½-2 inches beyond the surface of the flange 304A.

Referring to FIG. 20, the support members 306A, B may have a height substantially equal to the height of the flange 304A, or, alternatively, may be configured with a height less than the height of the flange 304A. In an embodiment, the support members 306A, B may have a height of about 15/16 inches. In alternative embodiments, the height of the support members 306A, B may be within the range of ½ to 3 inches.

As shown in FIG. 19, the support members 306A, B may extend away from the surface of the flange 304A in a direction substantially normal to the plane of the surface of the flange 304A. In alternative embodiments, the support members 306A, B may be configured to extend in outward, and away from, the flange 304A in a different direction than that shown, while still performing the functions described, herein. For example, in an alternative embodiment, the support members 306A, B may be configured to extend away from the surface of the flange 304A at 45 degree and 135 degree angles, respectively, to form a pair of brace structures that may be angled towards one another. In further alternative embodiments, the support members 306A, B may extend away from the surface of the flange 304A along curved, or dog-legged, paths.

As shown in FIG. 24, in an embodiment, the support members 306A,B may be disposed at locations on the flange 304A spaced apart by a distance sufficient to allow for the strap 11 to be routed between the support members 306A, B. When routed between the support members 306A, B, the strap 11 may be constrained against sliding off of the third stacking bracket 300 by one, or both, of the support members 306A, B. In a particular embodiment, the support members 306A, B may be spaced apart from one another by a distance of about 5 7/16 inches. In alternative embodiments, the space between the support members 306A, B may be within the range of about 3-8 inches. Further, as shown in FIGS. 18 and 24, the support members 306A, B may be disposed at locations on the flange 304A such that the raised insert portion (raised insert, generally, in FIG. 20) may be interposed between the respective planes in which the support members 306A, B extend. As such, the support member 306A, B may be configured to constrain the location of the strap 11, which may be routed over the top of the raised insert portion, with the strap 11 in contact with the top surface 302 and abutting the raised insert portion.

As shown in FIGS. 17A, 17B, and 19, the support members 306C, D may extend from the surface of the flange 304B. The support members 306C, D may have substantially the same features and may perform substantially the same functions as described, above, and in reference to the flange 304A and the support members 306A, B, respectively.

Referring to FIGS. 17B and 23A, in an embodiment, the support member 306A may comprise a top support surface 308A and a bottom support surface 310A. The top support surface 308A may comprise a substantially flat surface while the bottom support surface 310A may comprise a curved surface, forming a brace structure which may have a quarter-circle profile shape. In alternative embodiments, the top support surface 308A and a bottom support surface 310A may be configured to form brace structures having a different profile shape. For example, the top support surface 308A and a bottom support surface 310A may form a triangular, rectangular, L, or other profile shape, which may be capable of accommodating some, or all, of the functions of the support member 306A, as described herein.

The top support surface 308A may provide a surface for receiving a portion of the base rail 22 of the top unit 20. The top support surface 308A of the third stacking bracket 300 may have similar features, functions, and characteristics as those of the top support surface 217A of the second stacking bracket 200, as described above. The top support surface 308A may be a substantially flat surface and may be substantially co-planar with the plane of the top surface 302. The top support surface 308A may extend outwardly from a side surface of the bottom unit 10, when the third stacking bracket 300 is coupled to the bottom unit 10. The support member 306A may receive a portion of the base rail 22 of the top unit 20 along the top support surface 308A and may support a portion of the load of the top unit 20. The additional surface area for supporting the load of the top unit 20 provided by the top support surface 308A may reduce stress concentrations within the base rail 22 of the top unit 20.

Referring to FIGS. 17A, 17B, and 18, the support members 306B-D may comprise the top support surfaces 308B-D and the bottom support surfaces 310B-D, respectively. The top support surfaces 308B-D and the bottom support surfaces 310B-D may have substantially the same features, functions, and characteristics of the top support surface 308A and the bottom support surface 310A, as described above.

Referring to the particular embodiment shown in FIG. 24, the extension distance of the top support surface 308C beyond the surface of the flange 304B may be a distance sufficient to provide a barrier against sliding of the strap 11 past the support member 306C. As shown, the strap 11 may be routed over the third stacking bracket 300 and between the support members 306C, D to secure the unit 10, 20 to a flat surface, such as to the bed of a truck. The support member 306C may provide a barrier preventing the strap 11 from sliding off of the third stacking bracket 300. Similarly, the support members 306A, B, D may be provided with the top support surfaces 308A, B, D, respectively, extending a distance from the surface of the flanges 304A, B sufficient to provide a barrier for preventing the sliding of a strap 11 off of the third stacking bracket 300.

Those skilled in the art will appreciate that, in alternative embodiments, the profile shape, size, orientation, location, and spacing of the support members 306A-D provided may vary from those of the embodiment described, above, while still performing functions described herein. In a particular embodiment, the support members 306A-D provided may vary from the embodiment shown in response to the size and/or weight of the particular units 10, 20 to be stacked. For example, it will be appreciated that increasing the quantity, or size, of the support members 306A-D provided may increase the load bearing capability of the third stacking bracket 300, and may further reduce stress concentrations experienced by the base rail 22 of the top unit 20. Additionally, it will be appreciated that the location and/or spacing of the support members 306A-D along the length of the flanges 104A, B, respectively, may be varied in accordance with the size and/or weight of the units 10, 20 to be stacked as well as the width, or widths, and/or quantity of the straps 11 to be routed over the third stacking bracket 300.

Turning back to FIGS. 17A and 17B, in an embodiment, the flanges 304A, B may be implemented with the fastener apertures 312A-Q, as shown. The fastener apertures 312A-Q of the third stacking bracket 300 may have similar features, functions, and characteristics as those of the fastener apertures 232, 234 of the second stacking bracket 200, as described above. The fastener apertures 312A-Q may comprise any combination of holes, slots, cutouts, and the like, passing through the flanges 304A, B. One, or more, of the fastener apertures 312A-Q provided may be configured with a size and location that may correspond to one, or more, fastener apertures of the unit 10, 20 to which the third stacking bracket 300 may be coupled. One, or more, of the fastener apertures 312A-Q may be configured to receive a mechanical fastener for coupling the third stacking bracket 300 to the unit 10, 20. Additionally, one, or more, of the fastener apertures 312A-Q provided may be configured to provide clearance for a mechanical fastener that may be inserted into, or removed from, the unit 10, 20 without engaging the third stacking bracket 300, which may be coupled to the unit 10, 20.

As shown in FIG. 18A, in an embodiment, the flange 304A may be implemented with a combination of fastener apertures comprising the fastener apertures 312A-I. The fastener apertures 312A-G and the fastener aperture 312I may each be a hole configured to receive a mechanical fastener, such as a screw, bolt, rivet, and the like. The fastener aperture 312H may be a slot configured to receive a mechanical fastener, such as a screw, bolt, rivet, and the like.

As shown in FIG. 18B, in an embodiment, the flange 304B may be implemented with a combination of fastener apertures comprising the fastener apertures 312J-Q. The fastener apertures 312K-O and 312Q may each be a hole configured to receive a mechanical fastener, such as a screw, bolt, rivet, and the like. The fastener apertures 312J and 312P may each comprise a cutout that may be configured to allow one, or more, mechanical fasteners, such as screws, bolts, rivets, and the like to be inserted into the unit 10, 20 while the third stacking bracket 300 is coupled to the unit 10, 20 and without the fastener passing through the flange 304B.

According to the embodiment shown, the flanges 304A, B may be implemented with unique sets, patterns, or combinations of the fastener apertures 312A-Q. In alternative embodiments, the flanges 304A, B may be implemented with a common set, pattern, or combination, of the fastener apertures 312A-Q. The particular configuration of the fastener apertures 312A-Q shown is illustrative, only. Those skilled in the art will appreciate that a multitude of fastener aperture 312 combinations may be provided based on the particular fastener aperture configuration, or configurations, of the unit, or units, to which the third stacking bracket 300 is configured to couple.

As shown in FIGS. 21A and 21B, in an embodiment, the third stacking bracket 300 may be configured to fit over the corner 16 of the bottom unit 10. One, or more, of the fastener apertures 312A-Q may be disposed at locations along the surfaces of the flanges 304A, B, respectively, that may align with apertures (not shown) in the side surfaces of the bottom unit 10. Fasteners, such as screws, for example, may pass through the one or more fastener apertures 312A-Q, respectively, to threadably engage fastener apertures in the side surfaces of the bottom unit 10. Such fasteners may couple the third stacking bracket 300 to the bottom unit 10 and/or may couple components of the bottom unit 10 without engaging the third stacking bracket 300.

Referring to FIGS. 20 and 23A, the base member portion of the third stacking bracket 300 may include the undersurface 314. The undersurface 314 of the third stacking bracket 300 may have similar features, functions, and characteristics to those of the undersurface 223 of the second stacking bracket 200, described above. The undersurface 314 may provide a substantially flat contact surface for contacting the top cover 12 of the bottom unit 10. The undersurface 314 may be configured to provide a desired spacing between the stacked units 10, 20, as described below. In an embodiment, the undersurface 314 may be provided with the ribbing 316A-C.

The undersurface 314 may be disposed on the underside of the base member portion of the third stacking bracket 300, facing in a direction substantially opposite than that of the top surface 302. The undersurface 314 may be disposed within a plane substantially parallel to the plane of the top surface 302. In an embodiment, the undersurface 314 may be configured with a shape, and dimensions, substantially the same as those of the top surface 302, as described above.

According to the particular embodiment shown in FIG. 20, for example, the undersurface 314 may comprise the wedge shape. The undersurface 314 may comprise a substantially isosceles, right triangle having two equal-length sides. The undersurface 314 may have sides of about 7 inches in length. The undersurface 314 may surround an open area which may disposed at a location corresponding to the location of the raised insert portion, as described below. In alternative embodiments, the shape and dimensions of the undersurface 314 may differ from those of the embodiment shown in manners similar to those described, above, in reference to alternative embodiments of the top surface 302.

Figure 23B:
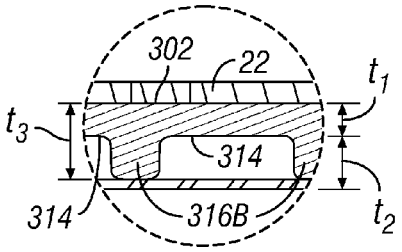
FIG. 23B is a detail view illustrating the thickness of the base member portion a third embodiment of the stacking bracket.

As best shown in FIGS. 23A and 23B, the undersurface 314 may provide a substantially flat contact surface extending within a plane substantially parallel to the plane of the top surface 302, and disposed at a distance $t_3$ from the top surface 302. The distance $t_3$ may be a thickness sufficient to provide a separation s between the base rail 22 of the top unit 20 and the top cover 12 of the bottom unit 10 that may allow for some flexing and/or bending of the base rail 22, caused by the weight of the top unit 20 when it is stacked on the bottom unit 10, without allowing for the base rail 22 to come into contact with the top cover 12. It will be understood by persons of ordinary skill in the relevant art that the distance $t_3$ may be varied to vary the separation s in response to the specific load to be supported by the third stacking bracket 300. In a particular embodiment, the undersurface 314 may configured to provide a contact surface disposed about 5/16 inches from the top surface 302 to maintain the desired spacing s between the base rail 22 and the top cover 12. In alternative embodiments, the undersurface 314 may configured to provide a contact surface disposed between about 3/16 and 1/2 inches from the plane of the top surface 302 to maintain the desired spacing s.

As shown in the particular embodiment of FIGS. 23A and 23B, the undersurface 314 may be disposed at a distance $t_1$ from the top surface 302. The distance $t_1$ may be less than the distance $t_3$ and insufficient to maintain the desired spacing s. In an embodiment, for example, the undersurface 314 may be disposed at a distance 5/32 inches from the plane of the top surface 302. In such an embodiment, the undersurface 314 may be provided with the ribbing 316A-C. The ribbing 316A-C may provide a contact surface disposed at the distance sufficient for maintaining the desired spacing s between the stacked units 10, 20.

The ribbing 316A-C of the third stacking bracket 300 may have similar features, functions, and characteristics as those of the ribbing 213 of the second stacking bracket 200, as described above. As shown in FIGS. 4 and 23B, the ribbing 316A-C may emanate from the underside of the third stacking bracket 300 and may extend downward in a direction away from the undersurface 314 of the third stacking bracket 300. Advantageously, the ribbing 316A-C may reduce the material cost of the third stacking bracket 300 while preserving strength in high stress areas of the base member portion of the third stacking bracket 300. As shown in FIG. 20, in an embodiment, the ribbing 316B, C may, similarly, provide internal bracing to increase the strength of the raised insert portion (raised insert, generally, in FIG. 20) while saving on material costs, as described below.

Referring to FIG. 23B, in the particular embodiment shown, the ribbing 316A-C may extend in a direction substantially normal to the plane of the undersurface 314. The ribbing 316A-C may comprise at a substantially flat lower end. Some, or all, of the rib sections of the ribbing 316A-C may extend a distance $t_2$ below the undersurface 314. Such rib sections of the ribbing 316A-C may, together, form a substantially flat contact surface disposed within a plane parallel to the plane of the top surface 302 for contacting the top cover 12 of the bottom unit 10.

The distance $t_2$ may be configured such that the cumulative distance, adding $t_1$ to $t_2$, is substantially equal to the distance $t_3$ sufficient to maintain the desired spacing s. Continuing the example from above, some, or all, of the ribbing 316A-C may be configured to extend 5/32 inches below the undersurface 314, whereby the contact surface for contacting the top cover 12 of the bottom unit may be disposed at the desired 5/16 inches from the plane of top surface 302.

Referring to FIG. 20, in an embodiment, the ribbing 316A-C may be configured with different widths. In such an embodiment, the ribbing 316A may have the greatest width, which may be about 5/16 of an inch. Alternatively, the width of the ribbing 316A may be within the range of about 1/4 to 3/8 inches. According to the particular embodiment shown, the ribbing 316B may be about 1/8 of an inch wide. Alternatively, the width of the ribbing 316B may be within the range of about 1/16 to 3/16 inches. According to the particular embodiment shown, the rib extension 316C may be about 3/32 of an inch wide. Alternatively, the width of the rib extension 316C may be within the range of about 1/16 to 1/8 inches.

As shown in FIG. 20, in a particular embodiment, the ribbing 316A of the third stacking bracket 300 may comprise of six substantially linear rib sections. The ribbing 316A may be disposed along the undersurface 314 at locations corresponding to the locations on the top surface 302 of the lower edges of the five walls comprising the ramp section of the raised insert portion, as described below. The sixth rib section comprising the ribbing 316A may be extend from the corner of the third stacking bracket 300 to the location along the undersurface 314 corresponding to the location along the top surface 302 at which the sloped surfaces 318A, B meet.

As shown in FIG. 20, in a particular embodiment, the ribbing 316B of the third stacking bracket 300 may comprise of four, substantially linear, parallel, rib sections. The ribbing 316B may extend in a direction parallel to the hypotenuse of the wedge outer shape of the undersurface 314. The ribbing 316B may be spaced apart from one another at distances of about 1 to 1½ inches, with one rib section disposed substantially at the edge of the undersurface 314 comprising the hypotenuse. As shown, one rib extension 316B may be configured to extend through the open area of the undersurface 314, forming a rib section extending across the open volume formed by the raised insert portion of the third stacking bracket 300.

As shown in FIG. 20, in a particular embodiment, the rib extension 316C of the third stacking bracket 300 may comprise of a single, substantially linear, rib section. The rib extension 316C may extend through the open area of the undersurface 314, forming a rib section extending across the protruding volume comprising the raised insert portion of the third stacking bracket 300. The rib section comprising the rib extension 316C may substantially bisect the open volume formed by the raised insert portion and may extend in a direction substantially perpendicular to the rib section of the ribbing 316B configured to extend through the open volume formed by the raised insert portion.

Those of ordinary skill in the art will appreciate that the widths, locations, quantity, pattern, and other features of the ribbing 316 may vary in accordance with design considerations as well as in response to the size and/or weight of the units 10, 20 to be stacked. The ribbing 316A-C configuration, as shown and described herein, is intended to be illustrative, only.

In alternative embodiments, the underside of the base member portion may comprise a uniform undersurface 314, with no ribbing 316 provided. In such an embodiment, the undersurface 314 may be disposed at a distance from the top surface 302 substantially equal to the desired thickness $t_3$, to maximize strength across the entire underside of the third stacking bracket 300. Further, in such an embodiment, the raised insert portion may comprise a solid volume of material.

Referring to FIGS. 21A and 21B, the base member portion of the third stacking bracket 300 may comprise a size and shape configured to fit over a corner 16 of the bottom unit 10. In the embodiment shown, the base member portion may form a triangular wedge shape configured to couple to the top cover 12 of the bottom unit 10 with each flange 104 extending over a side surface of the bottom unit 10. The base member portion of the third stacking bracket 300 may cover and protect the corner 16 of the bottom unit 10 and prevent damage to the top unit 20.

Referring to FIGS. 19, 22, and 23A, the third stacking bracket 300 may be provided with a raised insert portion (raised insert, generally). The raised insert portion of the third stacking bracket 300 may aid in setting the position of the top unit 20 relative to the bottom unit 10 in a manner similar to that described, above, in reference to the stacking insert 104 of the first stacking bracket 100 and the stacking insert 204 of the second stacking bracket 200. The raised insert portion of the third stacking bracket 300 may, additionally, resist sliding movement and/or dislodgment of the top unit 20 in response to disturbance forces, while the top unit 20 is stacked on top of the bottom unit 10. The raised insert portion of the third stacking bracket 300 may also provide a landing surface for receiving one, or more, straps 11.

According to the embodiment shown in FIGS. 17-24, the third stacking bracket 300 may be provided with a raised insert portion configured to perform each of the functions described, above. In alternative embodiments, however, the third stacking bracket 300 may be provided with a raised insert portion configured to perform less than all of the functions described, above. The raised insert portion of the third stacking bracket 300, as shown in FIG. 23A, may comprise of a ramp section (ramp, generally) and a vertical extension (vertical extension, generally).

Referring to FIGS. 18, 19, and 22, the raised insert portion of the third stacking bracket 300 may comprise a volume of material rising from, and extending above, the top surface 302 of the base member portion of the third stacking bracket 300. The raised insert portion may be disposed at a location along the top surface 302 adjacent to the portions of the top surface 302 configured to receive and support the base rail 22 of the top unit 20. In this configuration, the raised insert portion may fit within, and abut, the sides 23, 25 the base rail 22 of the top unit 20 during stacking. As shown in FIGS. 22 and 23A, when the top unit 20 is stacked on the bottom unit 10 and in the undisturbed position (the position of the base rail 22 in FIG. 23A), the base rail 22 may be supported by the top surface 302 while the raised insert portion may be disposed adjacent to, and abut, portions of the inner walls 23, 25 of the base rail 22.

As shown in FIGS. 18 and 23A, and as described below, the raised insert portion may comprise a volume of material having an irregular shape, as viewed from the top. The raised insert portion may have an irregular pentagonal perimeter shape at its base and a triangular perimeter shape at its top. In alternative embodiments, the third stacking bracket 300 may be provided with a raised insert portion having a shape other than that shown. Those skilled in the art will appreciate that, in alternative embodiments, the ramp section and/or the vertical extension may be provided with a multitude of different top-down shapes than that shown in FIG. 19 while still being capable of performing the functions described, herein.

As shown in FIG. 20, in an embodiment, the volume of material comprising the raised insert portion may be open at the bottom, forming an open volume within the raised insert portion. In such embodiments, the raised insert portion may be provided with internal rib sections, which may comprise one or more of the ribbing 316A-C, as described above, to brace and strengthen the raised insert portion. The ribbing 316A-C may be used to increase strength of the raised insert portion while saving on material costs. In an alternative embodiment, the raised insert portion may comprise a substantially solid piece of material to maximize strength. It will be understood by persons of ordinary skill in the art that the thickness of the walls and ribs comprising the raised insert portion may be varied to match the desired strength and load bearing capacity of the third stacking bracket 300.

Referring to FIG. 23A, the ramp section of the raised insert portion may provide walls that may act as ramps for setting the location of the top unit 20 relative to the bottom unit 10 in a manner similar to that described above in reference to the sloped surfaces 106, 108 of the first stacking bracket 100 and the sloped surfaces 206, 208 of the second stacking bracket 200. The ramp section of the third stacking bracket 300 may resist sliding movement of the top unit 20 relative to the bottom unit 10 in response to disturbance forces, while the top unit 20 is stacked on top of the bottom unit 10.

Referring to the embodiment of FIGS. 17A, 17B, and 18, in an embodiment, the ramp section may comprise the volume formed by the sloped surfaces 318A, B, a portion of height of the side surfaces 320A, B, and a portion of the height the back surface 322. In alternative embodiments, the ramp section may include fewer, additional, or different components than those shown.

The sloped surfaces 318A, B of the third stacking bracket 300 may have similar features, functions, and characteristics to those of the sloped surfaces 206, 208 of the second stacking bracket 200, described above. Referring to FIGS. 17 and 23A, the sloped surfaces 318A, B comprise walls of the ramp section for resisting sliding movement of the base rail 22 of a top unit 20 from the undisturbed position (the position of the base rail 22' in FIG. 23A) in response to disturbance forces. The sloped surfaces 318A, B may be adjoining surfaces of the ramp section. The sloped surfaces 318A, B may be disposed on the sides of the ramp section facing towards the sides of the top surface 302 provided with the flanges, 304A, B, respectively. The sloped surfaces 318A, B may meet, forming the edge of the ramp section disposed closest to the corner 16 of the bottom unit 10 to which the third stacking bracket 300 may be coupled.

Referring to FIGS. 19 and 23A, the sloped surfaces 318A, B may comprise substantially flat surfaces having a sloped profile rising up from bottom edges disposed within the plane of the top surface 302. In the embodiment shown, the respective bottom edges may be oriented substantially perpendicular to one another with each bottom edge further configured to extend in a direction substantially parallel to a side of the top surface 302. The sloped surfaces 318A, B may terminate at their, respective, top edges. The respective top edges of the sloped surfaces 318A, B may be disposed within a common plane at a height $h_1$ above the top surface 302. The respective top edges of the sloped surfaces 318A, B may be oriented substantially perpendicular to one another.

As shown in the embodiment of FIGS. 19 and 23A, the profiles of the sloped surfaces 318A, B may each be a constant extension at an angle g, relative to the top surface 302. The slope angle g may be within a range of between about 30° to about 70°. The sloped surfaces 318A, B may extend above the top surface 302 to the height $h_1$. The height $h_1$ may comprise about 1⅛ inches. In alternative embodiments, the height $h_1$ may be within a range of about ¾ to 3 inches.

Referring to FIGS. 17A, 17B, and 18, the side surfaces 320A, B and the back surface 322 may comprise walls of substantially uniform thickness for bracing the sloped surfaces 318A, B against crushing or buckling in a manner similar to that described, above, in reference to the side surfaces 207A-C of the second stacking bracket 200. The side surfaces 320A, B may meet the sloped surfaces 318A, B, respectively, at the sides of the sloped surfaces 318A, B opposite the sides at which the sloped surfaces 318A, B meet. The side surfaces 320A, B may comprise substantially flat surfaces rising up from the top surface 302 and be disposed within planes substantially perpendicular to the plane of the top surface 302.

Referring to FIGS. 18 and 19, the back surface 322 may meet the side surfaces 320A, B, respectively, at the sides of the side surfaces 320A, B opposite of the sloped surfaces 318A, B, respectively. The back surface 322 may comprise a substantially flat surface rising up from the top surface 302 and disposed in a plane substantially perpendicular to the plane of the top surface 302.

Referring to FIGS. 17A, 17B, and 23, the raised insert portion may further comprise of a vertical extension. The raised insert portion of the third stacking bracket 300 may increase the sliding resistance provided by the third stacking bracket 300 and may, additionally, provide one, or more, impact surfaces for resisting dislodgement of a stacked top unit 20 from the bottom unit 10 in response to a disturbance force. The vertical extension of the third stacking bracket 300 may be provided with some similar features, functions, and/or characteristics to those of the extended segment 240 of the second stacking bracket 200, as described above. In certain regards, however, as described herein, the features, functions, and/or characteristics of the vertical extension of the third stacking bracket 300 may differ from those of the extended segment 240 of the second stacking bracket 200.

The vertical extension portion may comprise a volume of material disposed above the plane in which the top edges of the sloped surfaces 318A, B are disposed. The vertical extension portion of the third stacking bracket 300 may comprise a pair of extension sides 324A, B, a pair of chamfers 326A, B, a first surface 328, and the upper portions of the side surfaces 320A, B and the back surface 322. The vertical extension portion may comprise the volume interposed between a first plane substantially parallel to the top surface 302 and at the height $h_1$ above the top surface 302 and a second plane substantially parallel to the top surface 302 and at the height $h_2$ above the first plane.

Referring to FIGS. 17-19, the extension sides 324A, B may be adjacent surfaces of the vertical extension. The extension sides 324A, B of the third stacking bracket 300 may have similar features, functions, and characteristics to those of the extension sides 242B, C of the second stacking bracket 200, as described above. The extension sides 324A, B may be disposed on the sides of the vertical extension facing towards the flanges, 304A, B, respectively. The extension sides 324A, B may meet, forming the edge of the vertical extension facing towards the corner 16 of the bottom unit 10 to which the third stacking bracket 300 may be coupled.

The extension sides 324A, B may meet the sloped surfaces 318A, B, respectively, at the bottom edges of extension sides 324A, B. As shown in FIG. 19, the extension sides 324A, B may comprise substantially flat surfaces having a slope, an angle j, relative to the top surface 302. The angle j may be greater than the slope, an angle g, of the sloped surfaces 318A, B relative to the top surface 302. In the embodiment shown, the slope profile of the third stacking bracket 300 may comprise a multiple positive step changes in slope. A first positive step change may be the slope increase from the slope of the top surface 302 to the respective slopes of the sloped surfaces 318A, B. A second positive step change may be the slope increase from the respective slopes of the sloped surfaces 318A, B to the respective slopes of the extension sides 324A, B.

As shown in FIG. 20, in the embodiment shown, the extension sides 324A, B may have a substantially vertical slope, the angle g, and may comprise surfaces oriented substantially perpendicular to the plane of the top surface 302, respectively.

It will be understood by persons of ordinary skill that the slope of the extension sides 324A, B may comprise a non-vertical slope (e.g. less than 90°) while still maintaining a slope profile of the third stacking bracket 300 which comprises two positive step changes, as described above.

Referring to FIGS. 17-20, in an embodiment, the extension sides 324A, B may be oriented substantially orthogonal to one another. The extension sides 324A, B may extend within planes substantially parallel to the surfaces of the flanges 304A, B, respectively. The extension sides 324A, B may terminate at their, respective, top edges. The top edges of the extension sides 324A, B may be disposed within a common plane. The top edges of the extension sides 324A, B may, further, be oriented substantially perpendicular to one another.

Referring to FIGS. 17-20, the chamfers 326A, B may comprise substantially flat, adjacent surfaces of the vertical extension. The chamfers 326A, B may be disposed on the sides of the vertical extension facing towards the flanges, 304A, B, respectively. The chamfers 326A, B may meet, forming the edge of the ramp section facing towards the corner 16 of the bottom unit 10 to which the third stacking bracket 300 may be coupled.

Referring to FIGS. 19 and 23A, the chamfers 326A, B may have sloped profiles at an angle of about 45° relative to the top surface 302. The slope angle of chamfers 326A, B may be within a range of between about 30° to about 70° relative to the top surface 302.

The chamfers 326A, B may meet the extension sides 322A, B, respectively, at the bottom edges of the chamfers 326A, B. In the embodiment shown, the respective bottom edges of chamfers 326A, B may be oriented substantially perpendicular to one another with the bottom edges extending in directions substantially parallel to a side of the top surface 302.

As shown in FIG. 20, in an embodiment, the chamfers 326A, B may terminate at their, respective, top edges at the first surface 328. The respective top edges of the chamfers 326A, B may be disposed within a common plane at a height $h_3$ above the top surface 302. The top edges of the chamfers 326A, B may be oriented substantially perpendicular to one another.

As shown in the embodiment of FIGS. 19 and 23A, the profiles of the chamfers 326A, B may comprise a constant extension at an angle relative to the top surface 302. In alternative embodiments, the chamfers 326A, B may have rounded profile shapes. In a further alternative, the vertical extension may not be provided with the chamfers 326A, B, whereby the vertical extension may have a squared profile along the top edges of the extension sides 324A, B.

Referring to FIGS. 18 and 23A, the vertical extension may terminate at the first surface 328. The first surface 328 may support the vertical extension, bracing the vertical extension against crushing or buckling in response to impacts with the base rail 22 of the top unit 20. In some embodiments, the first surface 328 may provide a landing surface for receiving a strap 11, which may be routed over the third stacking bracket 300 and used to secure the unit 10, 20 to which the third stacking bracket 300 is coupled to a flat surface, such as the bed of a truck.

As shown in FIG. 19, the first surface 328 may be a substantially flat surface which may be substantially parallel to the top surface 302. The first surface 328 may, in an embodiment, be proved with a rounded edge along the sides of the first surface 328 where the first surface 328 meets the side surfaces 320A, B, respectively, as well as along the side of the first surface 328 meeting the back surface 322. The first surface 328 may have a generally triangular shape, as viewed from the top, with sides that may be substantially parallel to the corresponding sides of the top surface 302.

As shown in FIG. 24, in an embodiment, the first surface 328 may be sized such that the strap 11 may be routed along a portion of the top surface 302 with the strap 11 abutting a side surface 320A or 320B of the third stacking bracket 300 on one side and a support member 306 on the other side, confining the location of the strap 11 to prevent the strap from sliding off of the third stacking bracket 300. Alternatively, the sides of the first surface 328 may be configured to have a length of less than the width of the strap 11. In such an embodiment, the strap may be routed over the first surface 328 so that the strap 11 wraps over one, or more, edges of the first surface 328. Routing the strap over the first surface 328 in this manner may provide frictional resistance to movement of the strap 11 relative to the third stacking bracket 300, as the strap 11 may grip the first surface 328 of the third stacking bracket 300. The strap 11 may be routed down the side of the unit 10, 20, and interposed between adjacent support members 306, whereby the support members 306 may confine the location of the strap 11 and prevent the strap from sliding off of the third stacking bracket 300.

As shown in FIGS. 19 and 23A, the vertical extension may extend above the plane in which the top edges of the sloped surfaces 318A, B may be disposed to a height $h_2$ above the plane in which the top edges of the sloped surfaces 318A, B are disposed. The height $h_2$ may be about 0.75 in. within a range of about 0.5-2.0 in. The overall height $h_3$ of the raised insert portion above the top surface 302 may be about 1⅞ inches. In alternative embodiments, the overall height $h_3$ of the raised insert portion may be within a range of about 1½ to 5 inches.

Those skilled in the art will appreciate that the overall height of the raised insert portion above the top surface 302 may be varied to vary the sliding and dislodgement resistance provided by raised insert portion, with greater overall height providing greater resistance. Those skilled in the art will also appreciate that the overall height of the raised insert portion must be less than the profile height of the base rail 22 of the top unit 20 so the third stacking bracket 300 may support the top unit 20 load at the top surface 302 of the third stacking bracket 300, without the raised insert portion contacting the top unit 20 when the top unit 20 is in an undisturbed position.

One, or more, stacking brackets 300 may be coupled to a bottom unit 10 at the corner, or corners, 16 using one, or more, mechanical fasteners to threadably engage an aperture, or apertures, of the bottom unit 10 and passing through one, or more, fastener apertures 312 of the stacking bracket, or brackets 100. With the stacking bracket, or brackets, 100 coupled to the bottom unit 10, as shown in FIG. 21, the top unit 20 may be stacked on top of the bottom unit 10.

Referring to FIGS. 22 and 23A, the top unit 20 may be stacked on top of the bottom unit 10 with the raised insert portion of the stacking bracket, or brackets, 300 positioned within the perimeter of a base rail 22 of the top unit 20. As shown in FIGS. 17A, 17B, and 22, the top surface 302 of the third stacking bracket 300 may extend around the sloped surfaces 318A, B to provide a surface for supporting the base rail 22 when in the undisturbed position (the base rail 22 in FIG. 23A) and for providing a surface where the base rail may come to rest to from the disturbed position (the base rail 22' in FIG. 23A).

The sloped surfaces 318A, B may be positioned adjacent to inner walls 23, 25 of the base rail 22 of the top unit 20. In the embodiment shown in FIG. 21, the sloped surfaces 318A, B may be positioned adjacent to the corner formed by a base rail 22 of the top unit 20. The sloped surfaces 318A, B may comprise a general wedge shape. As shown in FIGS. 21 and 23A, each sloped surfaces 318A, B may extend in a direction parallel to a respective adjacent portion of the base rail 22. The sloped surface 318A may, for example, extend in a direction x parallel to first wall 23, and the sloped surface 318B may extend in a direction y parallel to second wall 25.

As shown in FIG. 23A, the stacked top unit 20 may be rocked due to a disturbance force applied to the top unit 20, as may be experienced during transport of the top unit 20. This disturbance force may cause the top unit 20 to shift, or slide, relative to the bottom unit 10, and may cause a portion of the base rail 22 to lift above the top cover 12. FIG. 23A also shows the base rail 22 in a second disturbed position, the position of the base rail 22'.

The sloped surfaces 318A, B may impede displacement of the top unit 20 that has been stacked on top of the bottom unit 10. The sloped surfaces 318A, B of the third stacking bracket 300 may function as a ramp surface, an impact surface, or both, in a manner substantially similar to the sloped surfaces 106, 108 of the first stacking bracket 100 and the sloped surfaces 206, 208 of the second stacking bracket 200, as described above. Because of the proximity of the walls 23, 25 of the base rail 22 to the sloped surfaces 318A, B, the base rail walls 23, 25 may impact, recoil from, or ride up and along the sloped surfaces 318A, B, when the top unit 20 is rocked or bumped by the disturbance force. The weight of the top unit 20 and the inclination of the sloped surfaces 318A, B may resist upward movement of the base rail 22' causing the top unit 20 to slide down the sloped surfaces 318A, B and back toward the undisturbed position. Further, the sloped surfaces 318A, B may resist disengagement of the top unit 20 from its stacked configuration, when the top unit 20 is rocked or bumped to disturb its placement on the bottom unit 10.

The extension sides 320A, B of the third stacking bracket 300 may function as a second ramp and/or an impact surface in a manner substantially similar to the extension sides 242B, C of the stacking bracket 200, as described above. The increase in slope from the sloped surfaces 318A, B to the extension sides 320A, B, respectively, may increase the energy required to move the top unit 20 up and over the raised insert portion of the third stacking bracket 300.

Further, in a manner substantially similar to that described for the stacking bracket 200, the vertical extension may have an added function of extension to a greater height above the underlying top surface 302 than the sloped surfaces 318A, B, providing an impact surface for aiding in prevention of disengagement of the top unit 20 from the bottom unit 10 in response to an extreme disturbance force during transport of the units 10, 20. An extreme disturbance force may, for example, be strong enough to cause the top unit 20 to ride up the full height of the ramp section of the raised insert portion to the disturbed position (22'). In such instances, the base rail 22 may impact one, or more, extension sides 320 of the vertical extension of the raised insert portion. The vertical extension may act as an impact surface preventing further sliding, or disengagement, of the top unit 20 in response to the disturbance force. Following impact, the top unit 20 may recoil and slide down the sloped surfaces 318A, B, settling back to the undisturbed position with the base rail 22 contacting the top surface 302.

As shown in FIG. 21, a system of stacking brackets 300A-D may be used in combination as part of a system to support stacking of the top unit 20 on the bottom unit 10 in a manner similar to that shown and described in FIGS. 3A and 4. As shown, a third stacking bracket 300 may be coupled to each corner 16 of the top cover 12 of the rectangular-shaped bottom unit 10. The stacking brackets 300A-D may each have substantially the same configuration relative to the rail 22 of the top unit 20, as described above in reference to FIGS. 21-23A.

In the system shown in FIG. 21, the raised insert portion of each stacking brackets 300A-D may be positioned within the perimeter of the base rail 22 so that each stacking brackets 300A-D may receive a portion of the base rail 22, supporting a portion of the load of the top unit 20, as described above. As shown, and described, the stacking brackets 300A-D may work in combination to resist movement of the top unit 20 relative to the bottom unit 10 as well as aid in prevention of disengagement of the top unit 20 from the stacked configuration in response to a disturbance force.

In the preceding discussion, numerous specific details are set forth to provide a thorough understanding of the present invention. However, those skilled in the art will appreciate that the present invention may be practiced without such specific details. Additionally, for the most part, details concerning well-known features and elements have been omitted inasmuch as such details are not considered necessary to obtain a complete understanding of the present invention, and are considered to be within the understanding of persons of ordinary skill in the relevant art.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered desirable by those skilled in the art based upon a review of the foregoing description of preferred embodiments. Accordingly, it is appropriate that the appended claims be construed broadly and in a manner consistent with the scope of the invention.

The invention claimed is:

1. An apparatus for supporting stacking of a top heating, ventilation, and air conditioning (HVAC) unit on a bottom HVAC unit, the apparatus comprising:

a base member substantially triangular shaped and configured to couple to a top cover of the bottom HVAC unit at a corner of the top cover, with the base member comprising a top surface disposed within a first plane and configured to receive at least a portion of a base rail of the top HVAC unit, wherein the base rail of the top HVAC unit has a first portion and a second portion and wherein the first portion of the base rail is orthogonal to the second portion of the base rail thereby forming a corner of the base rail;

a raised insert portion extending above the top surface, the raised insert portion comprising:

a first and second ramp surface, each ramp surface comprising:

a first end disposed within the first plane; and a second end disposed at a first height above the first plane; and a first and a second extension side, each extension side comprising:

a bottom edge adjoined to a second end of the first or second ramp surface; and a top edge;

wherein each of the first and second ramp surfaces is configured to be positioned adjacent to an inner wall of the base rail of the top HVAC unit;

wherein each of the first and second ramp surfaces is configured to extend in a direction substantially parallel to the respective adjacent inner wall of the base rail of the top HVAC unit; and wherein each of the surfaces first and second extension sides is configured to face an inner wall of the base rail of the top HVAC unit.

2. The apparatus of claim 1, wherein the top surface is configured to receive at least a portion of the base rail when the base rail is in at least an undisturbed position.

3. The apparatus of claim 2, wherein each of the one or more extension sides extends in a direction substantially parallel to the respective facing inner wall of the base rail of the top HVAC unit.

4. The apparatus of claim 3, wherein the one or more ramp surfaces comprise a first sloped profile, and wherein the first sloped profile comprises a first constant slope relative to the first plane.

5. The apparatus of claim 4, wherein the first constant slope is equal to a slope in the range of 30-70° relative to the first plane.

6. The apparatus of claim 5, wherein the one or more ramp surfaces provide an inclined surface for resisting sliding movement of the top HVAC unit from an undisturbed position relative to the bottom HVAC unit.

7. The apparatus of claim 4, wherein the one or more extension sides comprise a second sloped profile, and wherein the second sloped profile comprises a second constant slope relative to the first plane.

8. The apparatus of claim 7, wherein the second constant slope is, at least, equal to a slope greater than that of the first constant slope.

9. The apparatus of claim 8, wherein the one or more extension sides provide an inclined surface for resisting dislodgment of the top HVAC unit from the bottom HVAC unit.

10. The apparatus of claim 8, wherein the second constant slope is, at most, equal to a slope of about 90° relative to the first plane.

11. The apparatus of claim 10, wherein the stacking bracket is configured to fit over, and couple to, a top corner of the bottom HVAC unit.

12. The apparatus of claim 11, wherein the apparatus comprises a single piece of molded plastic.

13. The apparatus of claim 1, wherein the top surface extends within a substantially flat, continuous, and uninterrupted surface for receiving a strap to secure the bottom HVAC unit to an underlying surface.

14. The apparatus of claim 13, wherein the base member further comprises a lower contact surface configured to contact the top surface of the bottom HVAC unit;

wherein the lower contact surface is disposed within a second plane, the second plane disposed substantially parallel to the first plane of the top surface; and wherein the distance between the top surface and the lower contact surface sufficient to maintain a desired separation between the base rail of the top HVAC unit and the top cover of the bottom HVAC unit.

15. The apparatus of claim 14, wherein the separation prevents the base rail of the top HVAC unit from contacting the top cover of the bottom HVAC unit, due to flexing of the base rail caused by the weight of the top HVAC unit.

16. The apparatus of claim 14, wherein the lower contact surface comprises one or more ribbing extensions extending downward and away from the lower surface, wherein the one or more ribbing extensions comprise a thickness configured to provide separation between the base rail of the top HVAC unit and the top cover of the bottom HVAC unit, wherein the separation prevents the rail from contacting the top cover of the bottom unit, due to flexing in the rail from the weight of the top unit.

17. The apparatus of claim 1, further comprising:

one or more mounting flanges, each mounting flange adjoining an edge of the top surface and extending downward, and away from, the first plane;

wherein the one or more mounting flanges are configured to contact a side surface of the bottom HVAC unit.

18. The apparatus of claim 17, wherein each of the one or more mounting flanges defines one or more apertures for receiving a mechanical fastener.

19. The apparatus of claim 17, wherein each of the one or more mounting flanges comprises one or more support members, wherein each of the one or more support members extends away from the surface of a mounting flange, and wherein each support member comprises a substantially flat top surface disposed within the first plane.

20. The apparatus of claim 19, wherein the support members are configured to receive a portion of the base rail of the top HVAC unit and at least partially support the load of the top HVAC unit.

21. The apparatus of claim 19, wherein one or more of the support members is configured to constrain movement of a strap over the one or more support members.

22. The apparatus of claim 1, wherein the apparatus comprises a single piece of an at least semi-rigid material.

23. A system for supporting stacking of a top heating, ventilation, and air conditioning (HVAC) unit on a bottom HVAC unit, the system comprising:

a first stacking bracket configured to support a portion of a base rail of a top HVAC unit, the first stacking bracket mounted on a top cover of a bottom HVAC unit at a first corner;

a second stacking bracket configured to support a portion of a base rail of a top HVAC unit, the second stacking bracket mounted on a the top cover of the bottom HVAC unit at a second corner;

a third stacking bracket configured to support a portion of a base rail of a top HVAC unit, the third stacking bracket mounted on the top cover of the bottom HVAC unit at a third corner;

a fourth stacking bracket configured to support a portion of a base rail of a top HVAC unit, the fourth stacking bracket mounted on the top cover of the bottom HVAC unit at a fourth corner;

wherein the first stacking bracket comprises:

a base member configured to couple to a top cover of the bottom HVAC unit, with the base member comprising an top surface disposed within a first plane and configured to receive at least a portion of the base rail of the top HVAC unit; and a raised insert portion extending above the first surface, with the raised insert portion comprising:

one or more ramp surfaces, with each ramp surface comprising:

a first end, wherein the first end is disposed within the first plane; and a second end, wherein the second end is disposed at a first height above the first plane; and one or more impact surfaces, with each impact surface comprising:

a bottom edge, wherein the bottom edge is adjoined to a second end of a ramp surface; and a top edge;

wherein each of the one or more ramp surfaces is configured to be positioned adjacent to an inner wall of a base rail of the top HVAC unit;

wherein each of the one or more ramp surfaces extends in a direction substantially parallel to the respective adjacent inner wall of the base rail of the HVAC unit; and wherein each of the one or more impact surfaces is configured to face an inner wall of a base rail of the top HVAC unit;

wherein the first stacking bracket, the second stacking bracket, the third stacking bracket, and the fourth stacking bracket are configured to operate in combination to resist disengagement of a top HVAC unit from the bottom HVAC unit, when the top HVAC unit is disturbed from an at-rest position, and wherein the at-rest position comprises at least a portion of the base rail of the top HVAC unit positioned on the base member top surface of the first stacking bracket and the stacking insert of the first stacking bracket located within the perimeter of the base rail.

24. The system of claim 23, wherein the first stacking bracket, the second stacking bracket, the third stacking bracket, and the fourth stacking bracket are configured to operate in combination to resist disengagement of a top HVAC unit from the bottom HVAC unit in response to a disturbance force capable of causing sliding movement of the top HVAC unit along, and relative to, the top cover of the bottom HVAC unit.

25. The system of claim 23, wherein the first stacking bracket, the second stacking bracket, the third stacking bracket, and the fourth stacking bracket provide substantially no resistance to substantially vertical lifting of the top HVAC unit relative to the bottom HVAC unit, whereby the first stacking bracket, the second stacking bracket, the third stacking bracket, and the fourth stacking bracket provide substantially no resistance to vertical lifting of the top HVAC unit off of the bottom unit.

* * * * *